US005473861A

United States Patent [19]

Fukunaga et al.

[11] Patent Number: 5,473,861

[45] Date of Patent: Dec. 12, 1995

[54] PACKING METHOD AND PACKING APPARATUS

[75] Inventors: Takashi Fukunaga; Shiro Seyasu; Takeomi Yasuda, all of Tokyo, Japan

[73] Assignee: Teraoka Seiko Co., Ltd., Tokyo, Japan

[21] Appl. No.: 142,046

[22] Filed: Oct. 28, 1993

[30] Foreign Application Priority Data

| | | | |
|---|---|---|---|
| Oct. 30, 1992 | [JP] | Japan | 4-293371 |
| Nov. 30, 1992 | [JP] | Japan | 4-320923 |
| Nov. 30, 1992 | [JP] | Japan | 4-320924 |
| Nov. 30, 1992 | [JP] | Japan | 4-320925 |
| Dec. 10, 1992 | [JP] | Japan | 4-330263 |
| Jan. 29, 1993 | [JP] | Japan | 5-002085 |
| Mar. 16, 1993 | [JP] | Japan | 5-055699 |

[51] Int. Cl.[6] ..... B65B 11/06; B65B 53/00

[52] U.S. Cl. ..... 53/441; 53/466; 53/556; 53/228

[58] Field of Search ..... 53/441, 466, 228, 53/229, 556

[56] References Cited

U.S. PATENT DOCUMENTS

| | | | |
|---|---|---|---|
| 1,816,085 | 7/1931 | Langhammer | 53/466 |
| 2,928,217 | 3/1960 | Case et al. | 53/228 X |
| 3,327,453 | 6/1967 | Willbrandt et al. | 53/228 |
| 3,967,433 | 7/1976 | Bonfiglioli | 53/228 X |
| 4,035,985 | 7/1977 | Aoyama et al. . | |
| 4,078,363 | 3/1978 | Ranzi . | |
| 4,137,691 | 2/1979 | Takahashi | 53/229 |
| 4,622,802 | 11/1986 | Takamura | 53/466 |
| 4,674,269 | 6/1987 | Denda . | |
| 4,709,531 | 12/1987 | Denda . | |
| 4,757,451 | 7/1988 | Denda . | |
| 4,827,694 | 5/1989 | Owen et al. | 53/441 |
| 4,884,209 | 11/1989 | Denda . | |
| 4,920,731 | 5/1990 | Rimondi et al. | 53/229 X |
| 4,951,447 | 8/1990 | Denda et al. . | |

FOREIGN PATENT DOCUMENTS

| | | | |
|---|---|---|---|
| 0468776 | 1/1992 | European Pat. Off. . | |
| 2256074 | 7/1975 | France . | |
| 2340855 | 9/1977 | France . | |
| 2410601 | 8/1979 | France | 53/556 |
| 457718 | 2/1992 | Japan . | |

OTHER PUBLICATIONS

English Language Abstract of JP 4–57718.

*Primary Examiner*—Linda Johnson
*Attorney, Agent, or Firm*—Sandler, Greenblum & Berstein

[57] ABSTRACT

The present invention relates to a packing method and an apparatus, wherein a substance to be packed is carried from a carrying-in section in which the substance is carried to a position under a packing section where a film stands by in a horizontally stretched state. The substance to be packed is lifted to the film and is covered on the upper surface with the film, and the end portions of the film are folded under the bottom portion of the substance to be packed. The packing method and packing apparatus are for a no-tray system for directly packing a substance to be packed without a tray. An article carried in and placed on a carrying-in section is received on a carrying base, and the carrying base is moved to a packing section where a film is drawn and stretched, to carry the substance to be packed to the packing section, thereby making it possible to carry the substance to be packed to the packing section for packing without damaging the article in not only a tray type packing form but also in a no-tray packing form.

25 Claims, 31 Drawing Sheets

PACKING METHOD AND PACKING APPARATUS

BACKGROUND OF THE INVENTION

1. Field of the Invention

The present invention relates to a packing method and a packing apparatus, and specifically to a packing method and a packing apparatus for carrying a substance to be packed from a carrying-in section in which the substance to be packed is carried to the position under a packing section where a film stands-by in the horizontally stretched state; ascending and pushing-up the substance to be packed to the film for covering the upper surface of the substance to be packed with the film; and folding the end portions of the film under the bottom portion of the substance to be packed. In particular, the present invention concerns the improvement of the so-called no-tray type packing method and its packing apparatus for directly packing a substance to be packed by means of a film without any tray in the circumstances that the environmental problem due to excessively increased refuses has been at stake.

2. Description of the Prior Art

Conventionally, as the packing apparatus used for carrying out the packing method of this type, for example, there has been known such an apparatus as disclosed in Unexamined Japanese Patent Publication No. HEI 4-57718. The prior art apparatus is so constructed as follows: Namely, a carrying conveyor is horizontally disposed extending from a carrying-in section for a substance to be packed, which is disposed outside a machine casing, to the position directly under a packing section, which is disposed within the machine casing. The substance to be packed is carried from the external carrying-in section to the position directly under the internal packing section. Then, the substance to be packed carried up to the terminal portion of carrying is supplied on a receiving base (so-called elevator head) disposed directly under the packing section so as to be freely moved up and down, when the receiving base is ascended. The receiving base is continuously ascended, and thereby the substance to be packed is pushed up to a film which stands-by in the horizontally stretched state at the packing section, so that the substance to be packed is packed with the film.

In the prior art apparatus, at the longitudinal positions of the carrying conveyor within the elevating/lowering range where the receiving base is movable up and down, there are provided clamping levers moved along with the ascending movement of the receiving base and guide plates moved by an independent drive means. Thus, when the substance to be packed is supplied from the conveyor to the receiving base, or when the substance to be packed is supplied to be ascended to the packing section, several pieces or a bundle of the substances to be packed are clamped by the above clamping levers and guide plates at front and rear portions for preventing the disorder. This often causes such a disadvantage that the substances to be packed are rubbed and damaged by the clamping levers and the guide plates when the receiving base is ascended to the packing section. In particular, in the packing form of the so-called no-tray system for directly packing the substance to be packed by means of a film without any tray in the circumstances that the environmental problem due to excessively increased refuses has been at stake, the substance to be packed is directly contacted with the clamping levers and the guide plates and is rubbed therewith, and accordingly the above disadvantage such as damage tends to be further easily generated. On the other hand, in the packing form of a tray system for packing the substance to be packed which is placed on a tray with a film together with the tray, the substance to be packed is not directly contacted with the clamping levers and the guide plates, the above disadvantage is lightened; however, for the packing form of the no-tray system, the packing is difficult.

SUMMARY OF THE INVENTION

Taking the above circumstances into consideration, the present invention has been made, and a general object of the present invention is to provide a packing method and an improved packing apparatus for carrying a substance to be packed to a packing section without any damage to the substance to be packed, which are particularly effective for the packing form of a no-tray system.

A principal object of the present invention is to provide a further concrete packing apparatus for carrying out the above-described packing method. To achieve this object, according to the present invention, there is provided a packing apparatus for carrying a substance to be packed carried in a carrying-in section to a packing section, and packing the substance to be packed with a stretched film at the packing apparatus, comprising:

- a packing section having a folding means;
- a roll film composed of a wound stretch film;
- a film drawing means for holding the leading edge of the roll film, and drawing the film to the packing section by a specified length;
- right and left clamping means for holding the drawn film in the stretched state at the packing section;
- a carrying-in section for placing a substance to be packed thereon;
- a carrying base movable in the horizontal and vertical directions;
- a means for vertically ascending the carrying base from the position under the carrying-in section such that the upper surface thereof is positioned higher than the upper surface of the carrying-in section, and supplying the substance to be packed from the carrying-in section to the carrying base;
- a means for horizontally moving the carrying base on which the substance to be packed is placed to the position under the packing section, and carrying the substance to be packed to the position under the packing section;
- a means for vertically moving the carrying base to the packing section, and pushing-up the substance to be packed toward the film of the packing section; and
- a means for folding the end portions of the film under the bottom portion of the substance to be packed.

A specific object of the present invention is to improve the right and left clamping means in the packing apparatus, wherein parts of the folding means are partially shared for those of the right and left clamping means, to reduce the number of parts, thus simplifying the structure; the right and left side edges of the film can be clamped in such a state that the interval between the film drawn to the packing section and each of the right and left folding plates is not larger; and the pre-stretching of the film in the width direction is possible.

Another specific object of the present invention is to improve the film drawing means of the packing apparatus, wherein the so-called centering is reasonably performed, that is, when the cut-film formed by cutting of the film drawn from the roll film in a specified length is drawn to the packing section, the longitudinal (back and forth) center of the cut-film is made to correspond to the center of the packing section (substance to be packed), thus enlarging the size of the packable substance and preventing the waste of the film.

A further specific object of the present invention is to improve the film drawing means in the packing apparatus, wherein the so-called centering and the longitudinal pre-stretching of the film are concurrently performed when the cut-film is drawn to the packing section, to thereby achieve the beautiful stretch packing without any wrinkling irrespective of the size of the substance to be packed.

Still a further specific object is to perform the longitudinal pre-stretching action of the film by the film drawing means, and perform the widthwise prestretching action of the film by the right and left clamping means.

Still a further specific object of the present invention is to improve the folding means in the packing apparatus, wherein a heating element is provided in the folding means for performing the heat seal for the film folding edges within the packing section, thus extremely reducing the number of parts and simplifying the structure.

Still a further specific object of the present invention is to provide, a detecting means for detecting whether or not the substance already packed is removed from the packing section, at the packing section in the packing apparatus, thus achieving the safety for the apparatus and the rapid operation thereof.

An additional specific object of the present invention is to improve the carrying base in the packing apparatus, wherein the rolling of the substance to be packed can be prevented during the substance to be packed is carried from the carrying-in section to the position near the packing section; and the substances to be packed are regularly aligned in a lateral row when the upper surfaces of the substances to be packed are covered with the film, to thereby prevent the substance to be packed from being damaged.

BRIEF DESCRIPTION OF THE DRAWINGS

FIG. 4(*b*) is an enlarged view of the heater within the circle (IVb) of FIG. 4.

FIG. 18(*b*) is a vertical sectional front view;

FIG. 19(*b*) is a vertical sectional front view;

FIG. 25(*b*) is a vertical sectional front view;

DESCRIPTION OF THE PREFERRED EMBODIMENTS

Figure 1:
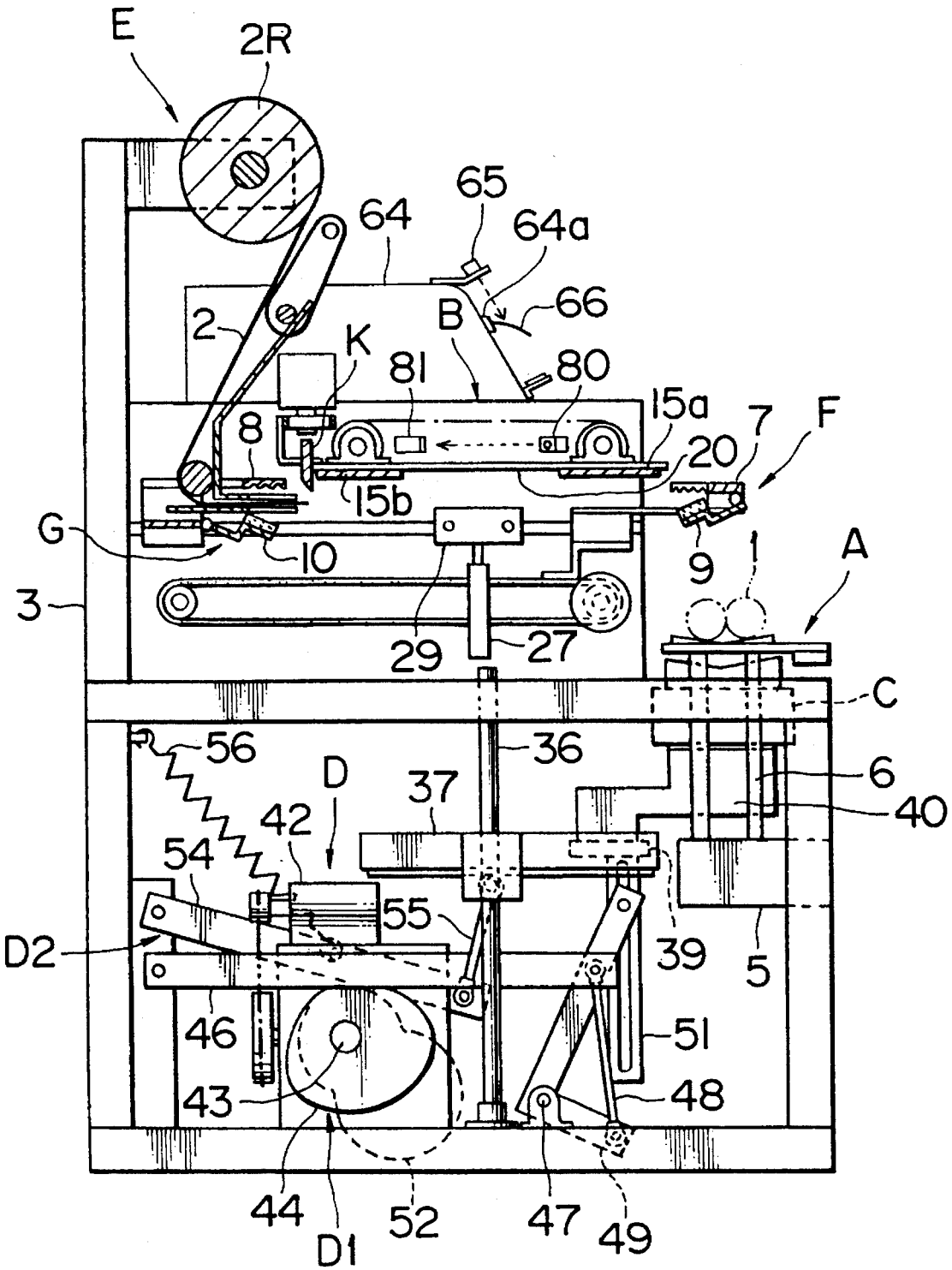
FIG. 1 is a side view showing a packing apparatus in which the present invention is carried oat.

FIG. 1 shows a side view of a whole packing apparatus for carrying out a packing method of the present invention. In this figure, a carrying-in section A on which an article 1 to be packed is placed is disposed on a front side of a machine casing 3, and a packing section B for horizontally supplying a film 2 for packing the article 1 in the stretched state is provided on the upper surface of the machine casing 3.

A carrying base C for carrying the article 1 received from the carrying-in section A to the packing section B is supported by a drive mechanism D in such a manner as to be movable in the horizontal and vertical directions within the machine casing 3. The carrying base C is horizontally moved to the carrying-in section A on which the article 1 is placed by a horizontally operating section D1 of the drive mechanism D, and vertically moved at the carrying-in section A by a vertically operating section D2 of the drive mechanism D, to receive the article 1 from the carrying-in section A.

Then, the carrying base C on which the article 1 is placed is horizontally moved to the position under the packing section B where the film 2 is horizontally supplied in the stretched state by the horizontally operating section D1, and is vertically moved toward the film 2 of the packing section B by the vertically operating section D2.

By these sequential operations, the carrying base C is horizontally and vertically moved from the carrying-in section A to the packing section B for carrying the article 1 from the carrying-in section A to the packing section B, and for pushing up the article 1 to the film 2 in the packing section B, thereby packing the article 1 with the film 2.

Figure 2:
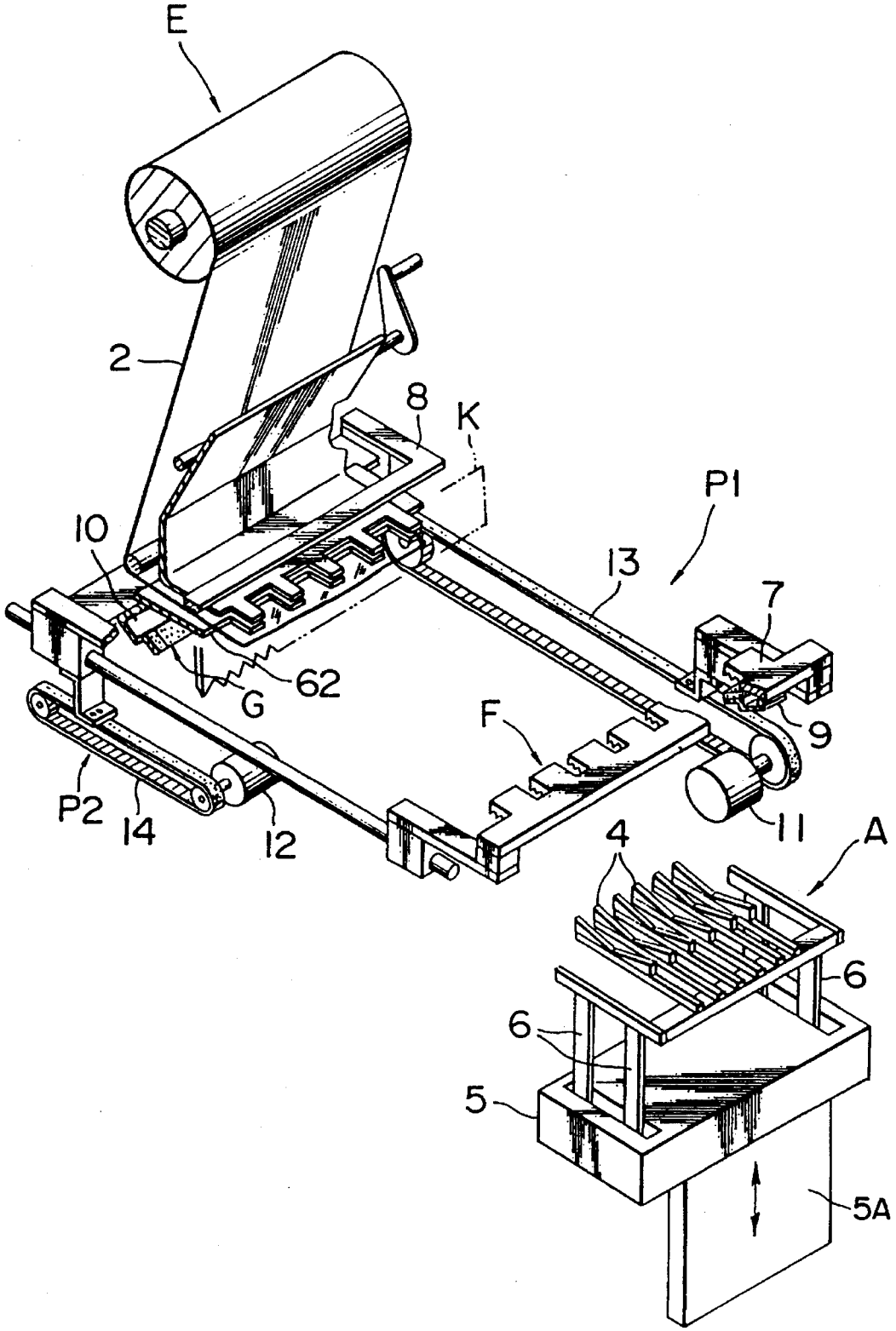
FIG. 2 is a perspective view showing front and rear grippers in a packing section.

As shown in FIG. 2, the carrying-in section A is so constructed that a plurality of placing levers 4 are juxtaposed with suitable intervals, and one-sided ends of these placing levers 4 are connected to each other so as to form an approximately comb-like shape. The carrying-in section A is intended to receive the article 1 which is placed on the placing levers 4 when receiving portions 34 of the carrying base C (described later) pass between respective placing levers 4.

The carrying-in section A is mounted on a weighing meter 5 containing a load cell disposed on the front surface of the machine casing 3 through supporting levers 6. Thus, the article 1 placed on the placing levers 4 are weighed, and the weight data, the price calculated on the basis of the weight data and the like are printed on a label 66 by means of a label printer 64, the label 66 being issued from an issue port **64*a*. The label printer 64 is disposed on one side of the upper surface of the machine casing 3 as shown in FIG. 1**.

The packing section B includes a front gripper F for holding the leading edge of the film 2 and for drawing the film from a film supply apparatus E by a specified length, which is horizontally movably disposed over the carrying-in section A on the front surface of the machine casing 3; and a rear gripper G for holding the rear end of the film 2 drawn to the upper portion within the machine casing 3, which is horizontally movably disposed on the rear surface side of the machine casing 3 in the direction of being opposed to the front gripper F.

In addition, a roll of film 2R composed of a wound stretch film as the packing material is held by the film supply apparatus E. The film 2 drawn from the roll film 2R passes through film holding plates 61.and 62, and is horizontally drawn over the packing section B. The film holding plates 61 and 62, each having the leading edge portion formed in a comb-like shape, are provided directly before the rear side glipper G under the stand-by condition in such a state as to be superposed to each other, and forms an interval for permitting the passing of the film 2 between both supporting plates 61 and 62. Further, the drawing length of the film 2 drawn through the film holding plates 61 and 62 is set to be a specified dimension according to the size of the article 1.

The film drawn by means of the front gripper F by a specified length is held at the rear end portion by means of the rear gripper G, and then cut by a cutter K disposed at the leading edge portions of the film holding plates 61 and 62.

In the packing section B, right and left clamping apparatuses H (see FIG. 3) for holding the right and left side edges of the film 2 are disposed on both sides of the machine casing 3 perpendicular to the drawing direction of the film 2, and thus the four side edges of the film 2 drawn by the film supply apparatus E are held by the apparatuses F, G and H, to stretch the film 2.

The front gripper F and the rear gripper G includes upper side fixed clamp plates 7 and 8, and lower side movable clamp plates 9 and 10 which are opened and closed with respect to the fixed clamp plates 7 and 8 by cylinders (not shown), respectively. The front gripper F and the rear gripper G are fixedly supported to timing belts 13 and 14 which are rotated in the longitudinal direction by special motors 11 and 12 disposed on both sides of the machine casing 3 so as to be advanced and retreated by the motors 11 and 12, respectively (see FIG. 2).

Namely, the motor 11 and the timing belt 13 constitute a transfer mechanism P1 for the front gripper F, and the motor 12 and the timing belt 14 constitute a transfer mechanism P2 for the rear gripper G.

On the upper portion of the disposed apparatuses F, G and H, folding apparatuses I and J for folding the front and rear edges and the right and left side edges of the film 2 under the bottom portion side of the article 1 after the article 1 is ascended toward the film 1 by the carrying base C.

In the front and rear folding apparatuses I, as shown in

Figure 3:
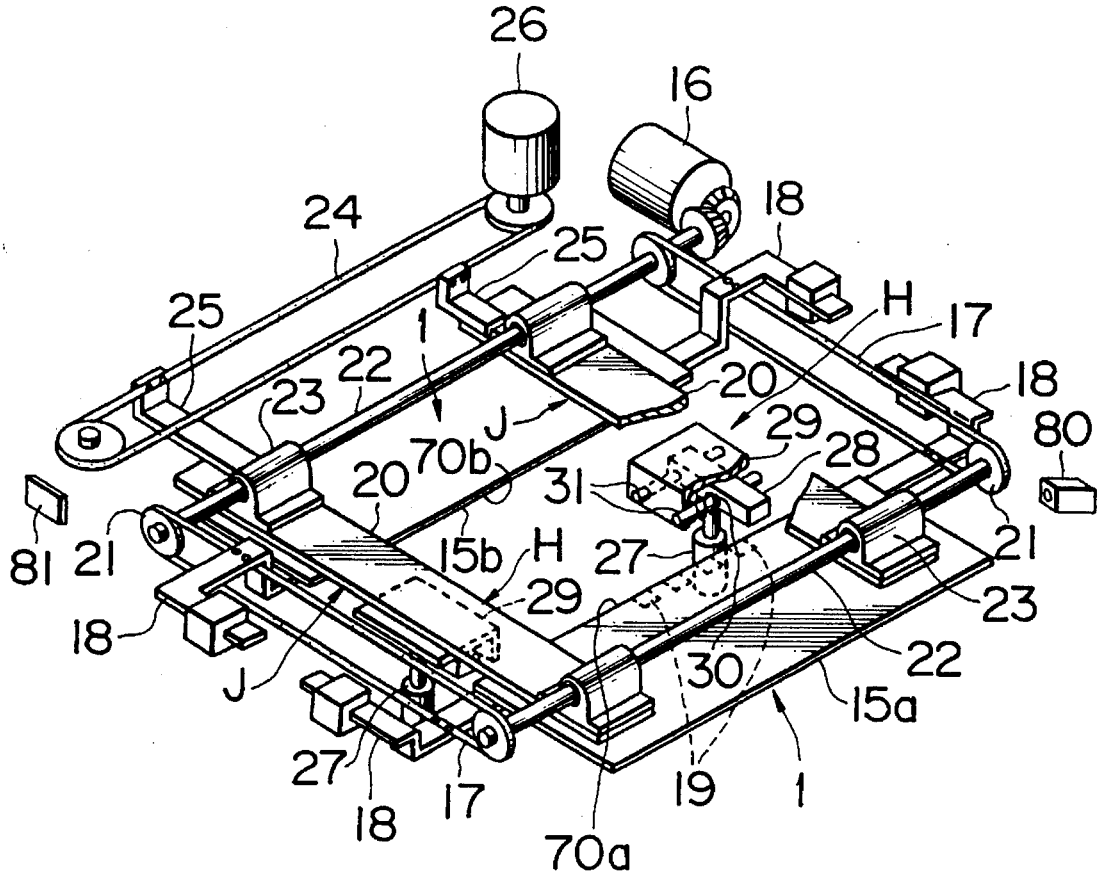
FIG. 3 is a perspective view showing main parts of front and rear, and right and left folding apparatuses in the packing section.

FIG. 3, two front and rear folding plates 15*a* and 15*b* extending in the width direction of the machine casing 3 are horizontally movably disposed back and forth while being divided for the front gripper F side and the rear gripper G side. The folding plates 15*a* and 15*b* are fixedly connected at both end portions to drive chains 17 rotated by a motor 16 which are wound in the longitudinal direction on both side portions of the machine casing 3 through connecting bars 18. The folding plates 15*a* and 15*b* are closed to each other with the synchronous speed, to thus concurrently fold the leading edge and the tailing edge of the film 2 under the bottom portion side.

Figure 4A:
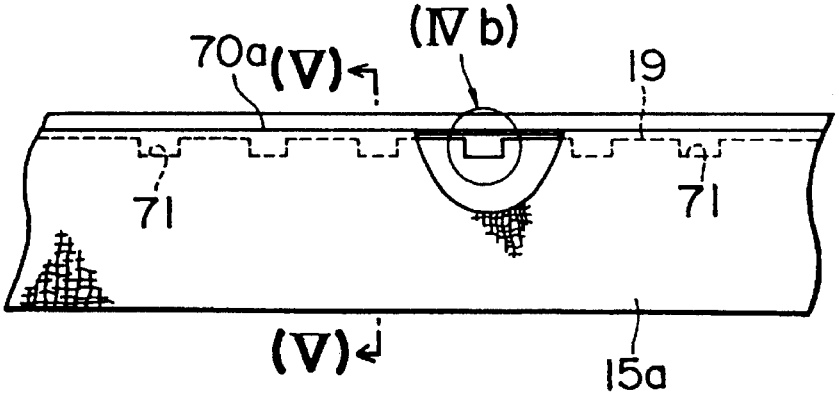
FIG. 4(*a*) is a plan view showing a main part of a folding plate provided with a heater.
Figure 4B:
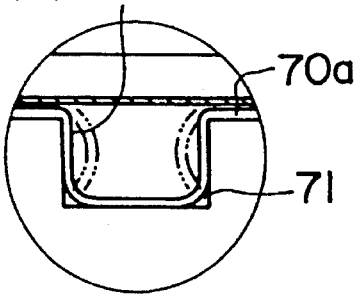
Figure 5:
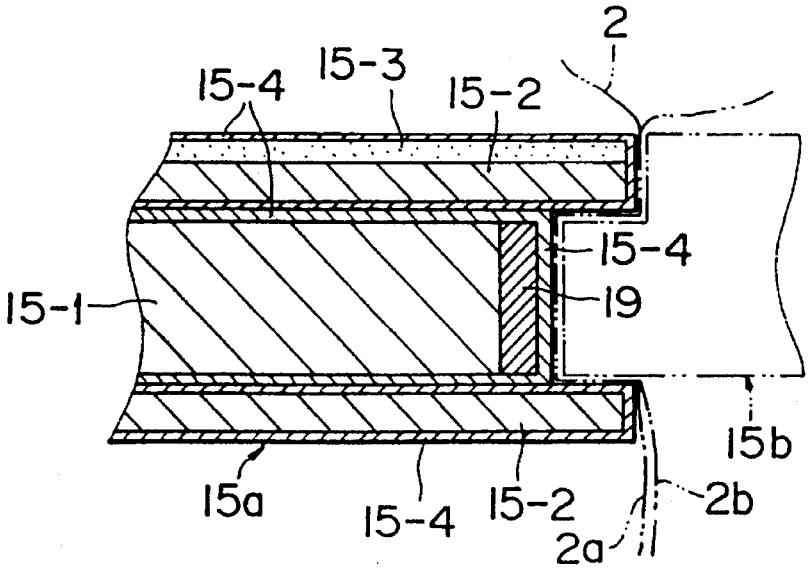
FIG. 5 is an enlarged sectional view taken along the line V—V of FIG. 4.

In addition, as shown in FIGS. 3, 4 and 5, a heater 19 for heat seal is embedded in a folding edge 70*a* of either of the front and rear folding plates 15*a* and 15*b* (in the figure, the front folding plate 15*a*).

The heater 19 is intended to perform the fusing when the folding edge 70*b* of the rear folding plate 15*b* and the folding edge 70*a* of the front folding plate 15*a* are abutted on and press-contacted with each other for preventing the front and rear edges 2*a* and 2*b* of the film 2 folded under the bottom portion of the article 1 from being separated. A nichrome wire is provided, within the folding width range of the front and rear edges 2*a* and 2*b* of the film, on the central portion in the edge direction of the folding edge 70*a* of the front folding plate 15*a* formed in the recessed shape into which the folding edge 70*b* of the rear folding plate 15*b* is fitted. Further, the heater 19 is formed in a corrugated shape in correspondence to the corrugated folding edge 70*a*, so that the extension (thermal expansion change) of the heater 19 is absorbed and relaxed at the corrugated recessed portion 71 for reducing the load stress due to the extension, thereby preventing the breaking of the heater 19, that is, the nichrome wire (see FIG. 4).

In addition, the front folding plate 15*a* of this embodiment is provided with the heater 19 along the folding edge 70*a*. Specifically, as shown in FIG. 5, a plate material 15-1 formed of heat-resisting material approximately in a rectangular shape in a plan view is sandwiched between the upper and lower aluminum plates 15-2 formed approximately in a rectangular shape in a plan view, to thus form the heat-resisting plate material 15-1 formed in a corrugated shape, and the heater 19 is mounted in the corrugated shape along the corrugated edge of the heat-resisting plate material 15-1. Further, a sponge 15-3 is additionally provided on the upper surface of the upper aluminum plate 15-2 for preventing the article 1 for no-tray packing from being damaged, and they are covered with a cloth 15-4 made from nylon being less in adhesion of the film 2.

On the other hand, the right and left folding apparatuses J are disposed on both sides of the machine casing 3 horizontally movably in the right and left in such a state that the strip-like folding plates 20 extending between the front and rear folding plates 15*a* and 15*b* which stand-by in the closed state are positioned over the front and rear folding plates 15*a* and 15*b*. In the right and left folding apparatuses J, guide bushes 23 provided on the front and rear ends are slidably insertingly fitted around two rotational shafts 22 supported so as to be interconnectedly rotatable through chains 17 and sprockets 21, and the rear ends of the right and left folding plates 20 are fixed to a chain 24 disposed on the rear gripper G through connecting arms 25. The right and left folding plates 20 are closed to each other with the synchronous speed by the operation of a motor 26, to concurrently fold the right and left side edges of the film 2 under the bottom portion side of the article 1.

In the right and left clamping apparatuses H, elevating frames 28 are connected to the upper ends of rods of air cylinders 27 provided under the right and left folding plates 20 which stand-by in the closed state, and movable clamping plates 29 being L-shaped in section are mounted on the elevating frames 28 through guide pins 31 with energizing springs 30 to be thus supported movably in the opening direction of the right and left folding plates 20. The movable clamping plates 29 are ascended by the cylinders 27 to be abutted on the lower surfaces of the right and left folding plates 20, to hold the right and left side edges of the film 2.

Figure 6:
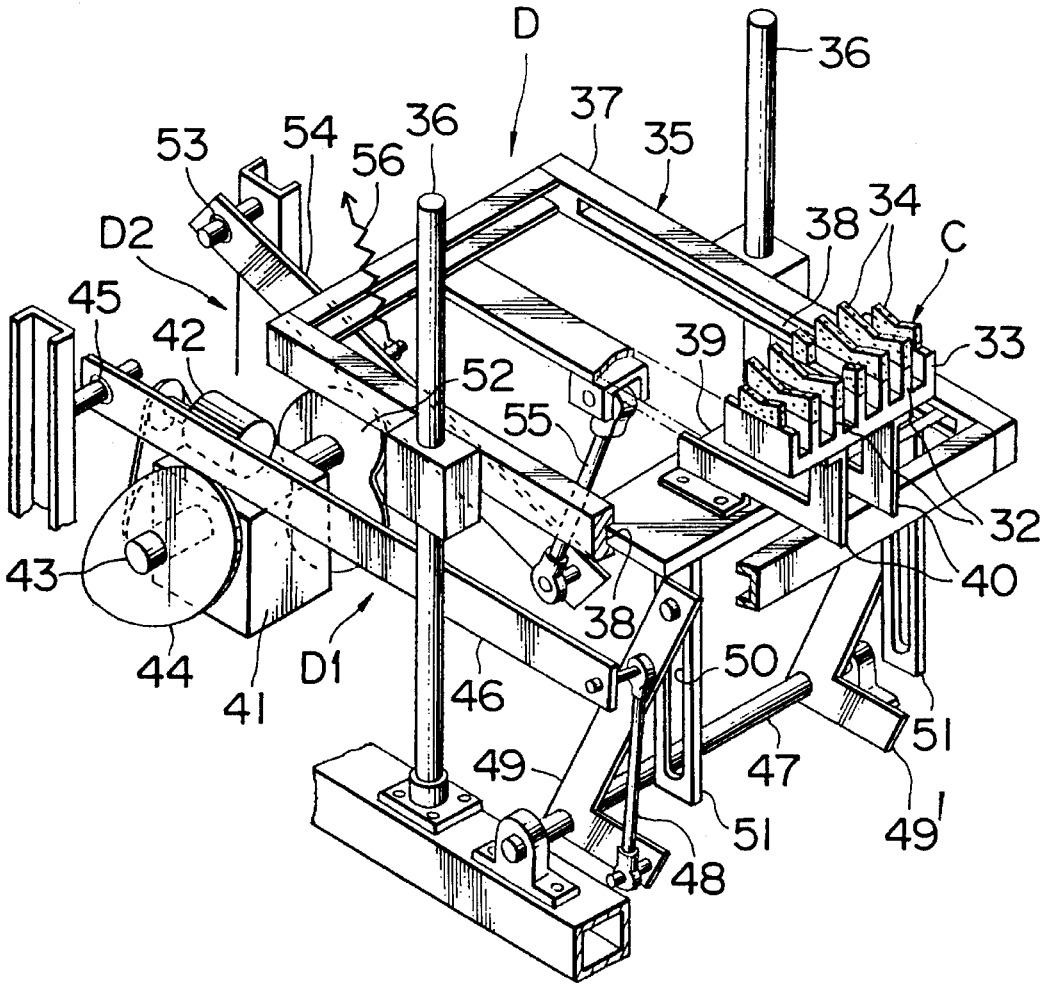
FIG. 6 is a perspective view showing main parts of a carrying base and its mechanism.

The carrying base C receives the article 1 placed on the carrying-in section A and already weighed, and carries the article 1 to the position under the packing section B. After that, the carrying base C is drawn from the position under the packing section B to push-up the article 1 to the stretched film 2. As shown in FIG. 6, the carrying base C includes a head base 33 formed of raised portions 32 with such intervals as to pass through the intervals between the comb-like placing levers 4 constituting the carrying-in section A; and receiving portions 34 for receiving the article 1 are fixed on the raised portions of the head base 33.

The carrying base C is supported by the drive mechanism D through a supporting member 35, and is moved in the horizontal and vertical directions within the machine casing 3 by operation of the drive mechanism D.

The drive mechanism D provided on the lower portion within the machine casing 3 is intended to move the carrying base C from the carrying-in section A to the packing section B, and which includes the horizontally operating section D1 for horizontally moving the carrying base C supported by the supporting member 35 between the carrying-in section A and the packing section B; and the vertically operating section D2 for vertically moving the carrying base C at respective positions between the carrying-in section and the packing section B.

The supporting member 35 includes guide columns 36 erected on both sides of the machine casing 3 in such a state that the lower ends are fixed; vertically moving frames 37 of a rectangular shape in a plan view horizontally disposed within the machine casing 3 in such a manner that both side frame portions thereof are vertically slidably supported between both the guide columns 36; and front and rear moving plate 39 vertically slidably supported within the moving frames 37 by locking of both the side portions thereof in guide grooves 38 provided in the inner surfaces of the side frames of the vertically moving frames 37. The head base 33 of the carrying base C is mounted on the front and rear moving plates 39 through supporting legs 40 being L-shaped. With these supporting legs 40, the carrying base C is capable of entering under the carrying-in section A without enlarging the length of the supporting levers 6 (see FIGS. 1, 2 and 6). The horizontally operating section D1 includes a cam 40 mounted to an output shaft 43 of reduction gear box 41 driven by operation of a motor 42; and a rocking arm 46 interconnected to the cam 44 and vertically rocked around a rear end rotatably supporting portion 45 by rotation of the cam 44. Further, the horizontally operating section D1 includes a starting arm 49 formed with an arm main body being approximately L-shaped, wherein the angular portion thereof is rotatably supported by a rotational shaft 48 installed on the bottom portion of the machine casing 3, and the rocking end of the rocking arm 46 is connected to the short side end portion through a connecting arm 48; and a vertical arm 51 hung from the lower surface of the front and left moving plate 39 of the supporting member 35, wherein the long side end portion of the starting arm 49 is engaged in a connecting slot 50 formed approximately throughout the whole length so as to be slidably connected to the starting arm 49 along the slot 50.

Figure 7:
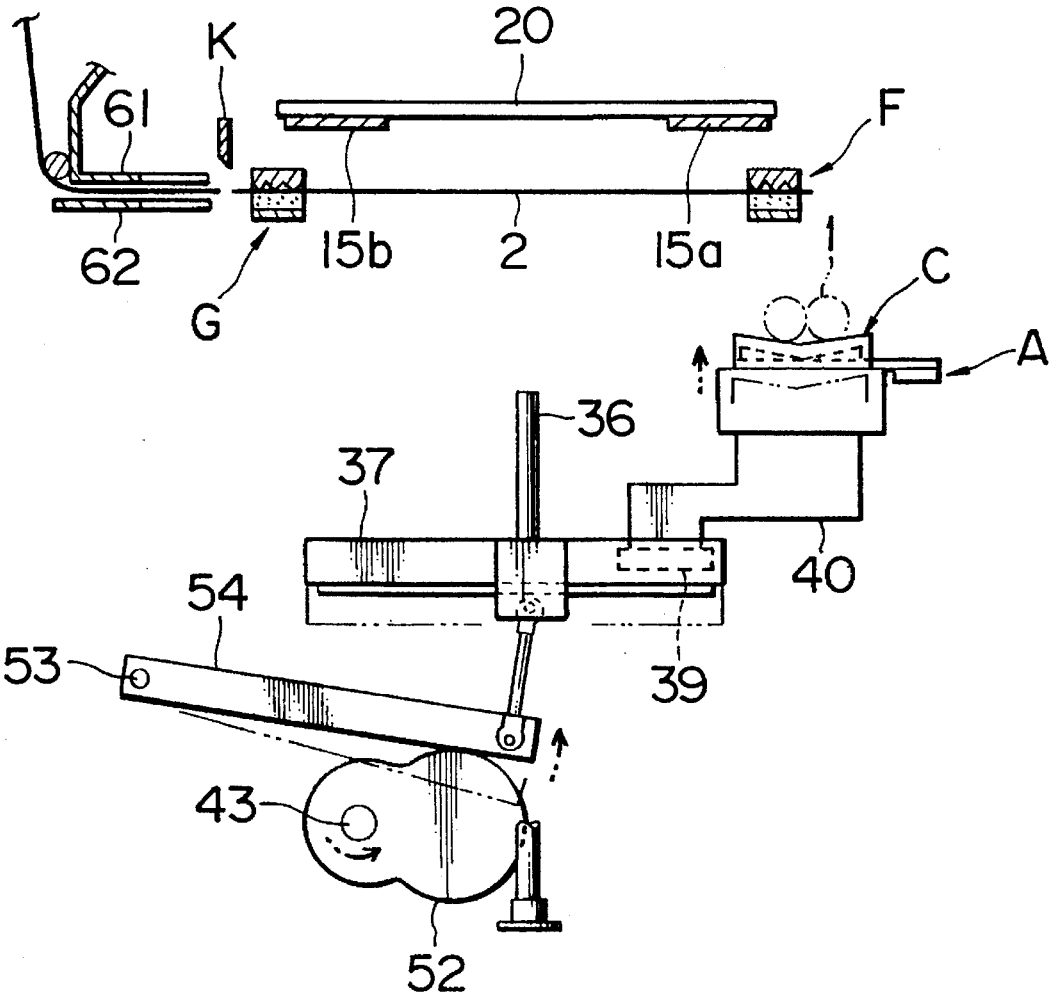
FIG. 7 is a schematic view showing the state where the carrying base receives an article from the carrying-in section.
Figure 8:
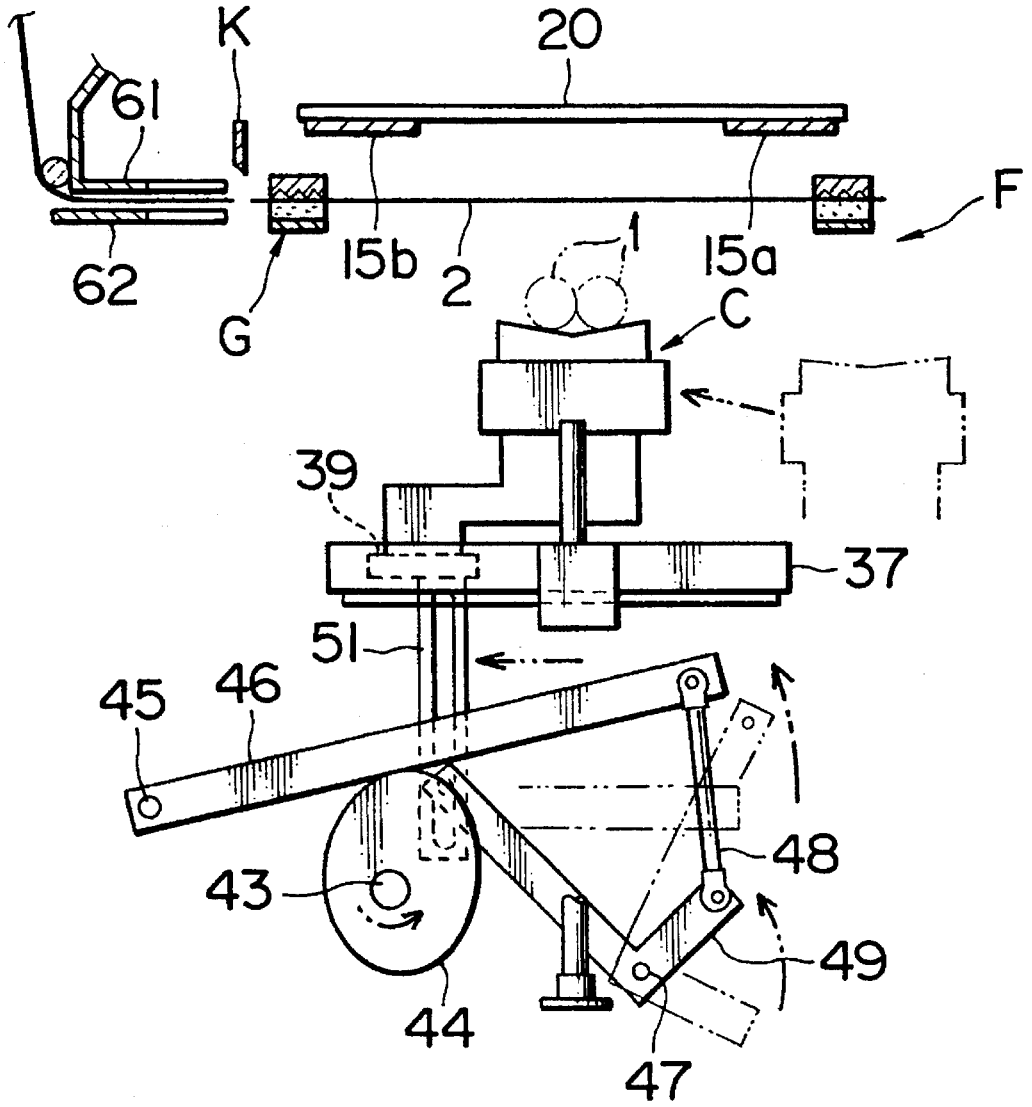
FIG. 8 is a schematic view showing the state where the carrying base on which the article is placed is moved to a position under the packing section.
Figure 10:
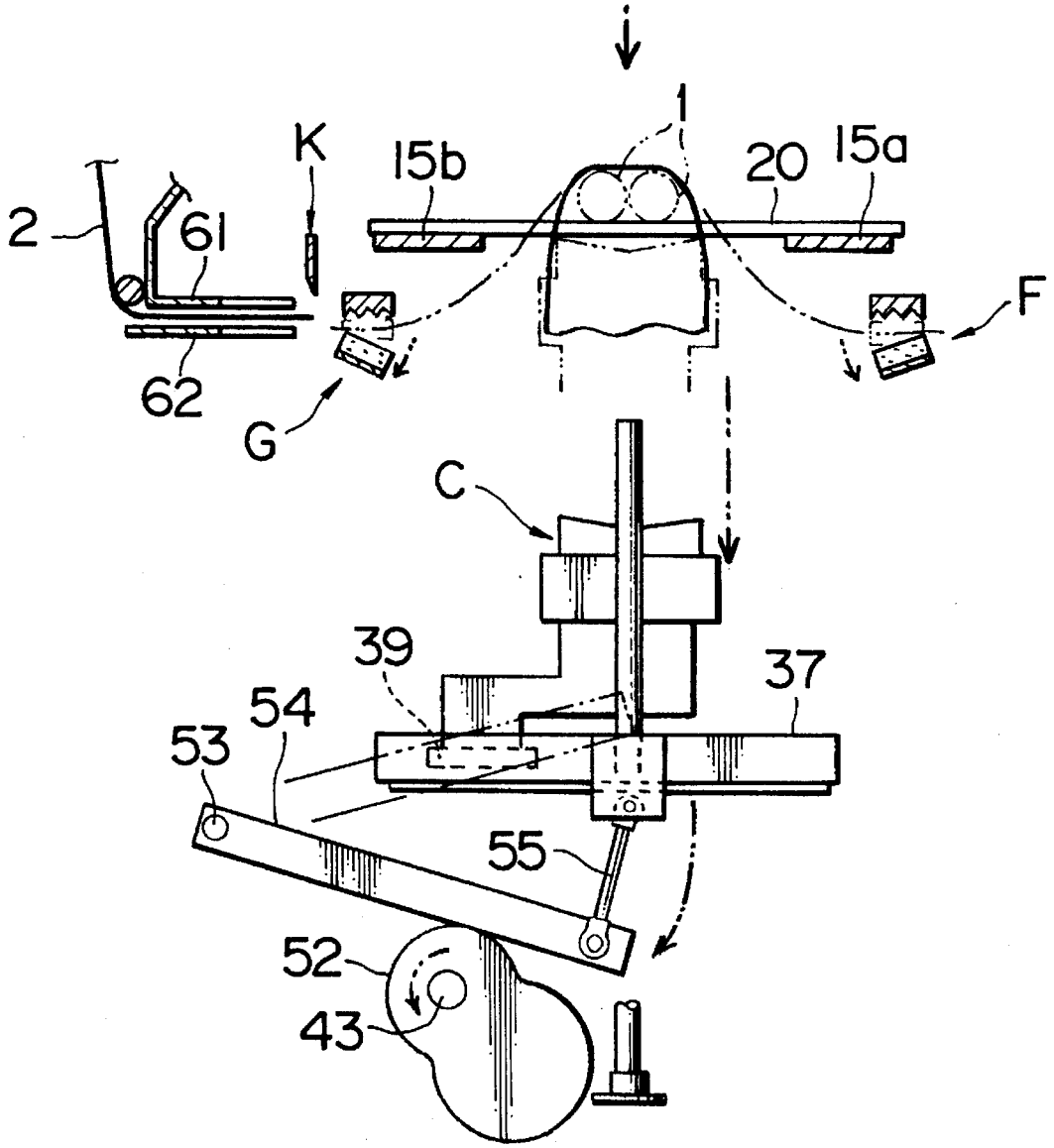
FIG. 10 is a schematic view showing a packing process for an article by right and left folding apparatuses.
Figure 11:
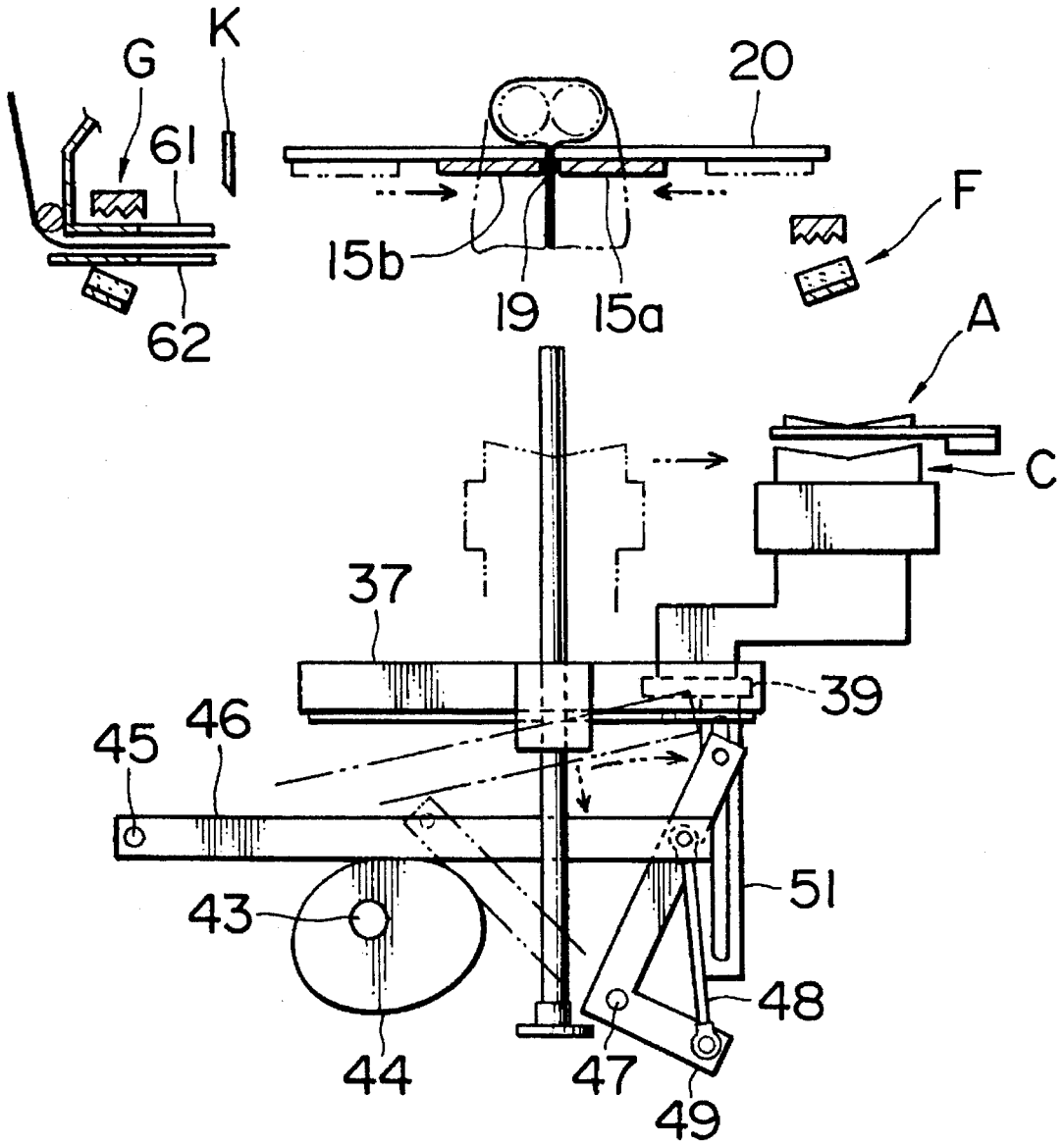
FIG. 11 is a schematic view showing the packing form for the article by front and rear folding apparatuses.

The horizontally operating section D1 is intended to cause the longitudinal movement around the rotational shaft 47 on the long side of the starting arm 49 by the vertical rocking operation of the rocking arm 46 performed along the cam floor of the cam 44 turned by means of the main motor 42, and to move the carrying base C from the carrying-in section A to the position under the packing section B through the front and rear moving plates 39 (in the states as shown in FIGS. 7 and 8), and further, to move the carrying base C from the position under the packing section B to the position under the carrying-in section A (from the state in FIG. 10 to the state in FIG. 11).

On the other hand, the vertically moving operating section D2 includes a cam 52 mounted on the cam shaft 43; a rocking arm 54 connected to the cam 52 and vertically rocked around a rear end rotatably supporting portion 53; and a connecting arm 55 mounted with end portions connected to the rocking end of the rocking arm 54 and the vertically moving frame 37 of the supporting member 35. Along with the vertically rocking operation of the rocking end of the rocking arm 54 along the cam floor of the cam 52 turned by the main motor 42, the carrying base C is vertically moved at respective positions between the carrying-in section A and the packing section B through the vertically moving frame 37.

Figure 9:
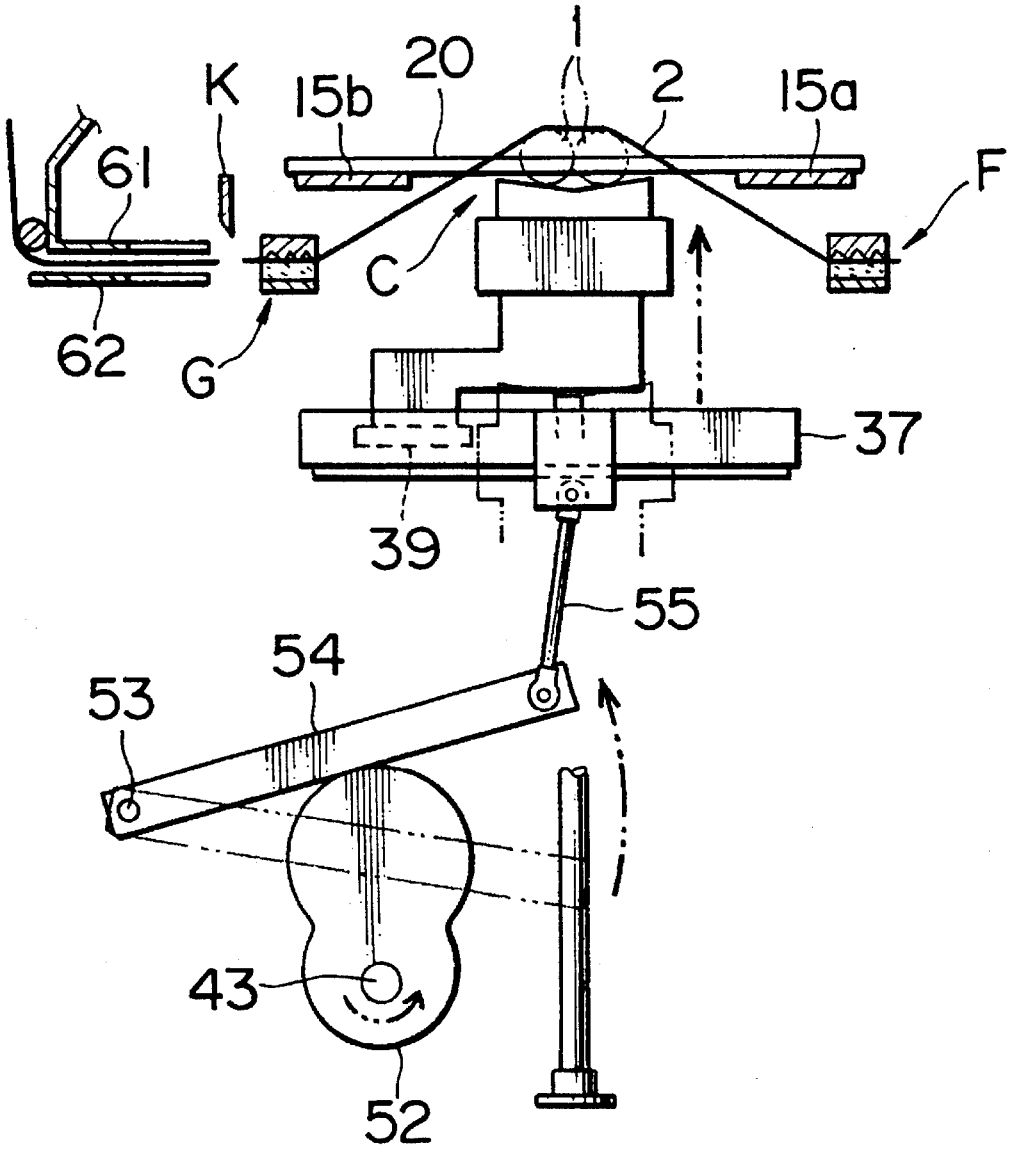
FIG. 9 is a schematic view showing the state where the carrying base is ascended to a film and supplies the article to the packing section.

Namely, in the carrying-in section A, carrying base C is ascended from the state in FIG. 1 to the state in FIG. 7; and in the packing section B, it is ascended from the state in FIG. 8 to the state in FIG. 9, and is descended from the state in FIG. 9 to the state in FIG. 10.

Additionally, in FIG. 1, reference numeral 65 indicates a reflection type sensor for detecting whether or not the label 66 issued from the label issue port **64*a* of the label printer 64 is removed from the issue port 64*a*. If the label 66 issued in the last packing operation is not removed (discharged) from the label issue port 64a by the operator, the label printer 64 is controlled to prohibit the issue of the next label 66**.

Further, reference numeral 80 indicates-a detecting means for detecting whether or not the article 1 already packed is removed from the packing section B by the operator, and for supplying a command of permitting the starting of the next packing operation.

The detecting means 80 turns on when a light is shielded by the article 1 ascended and pushed up to the packing section B by means of the carrying base C; and turns off when the light is again irradiated to a reflection plate 81 by removal of the article 1 from the packing section B after completion of the packing and is reflected from the reflection plate 81, thereby detecting whether or not the article 1 already packed is removed from the packing section B.

The detecting means 80 is disposed at one side corner on the diagonal at the position with a specified height on the upper side of the packing section B, and is intended to usually irradiate a light to the reflection plate 81 disposed on the opposed side corner.

By use of the stretch packing apparatus having the above construction, the packing of the article 1 proceeds by sequential operation of each apparatus and each mechanism section with a specified timing through the sequence and timer control by a control section (not shown) composed of a microcomputer.

Hereinafter, the packing processes will be described with reference to FIGS. 7 to 11, and FIGS. 12 to 26.

An operator places the article 1 on the carrying-in section 1, and turns on an operating switch for the packing apparatus. The carrying base C in the stand-by condition under the carrying-in section A is first ascended by the vertically operating section D2, and receive the article 1 from the carrying-in section A (see FIG. 7).

Figure 12:
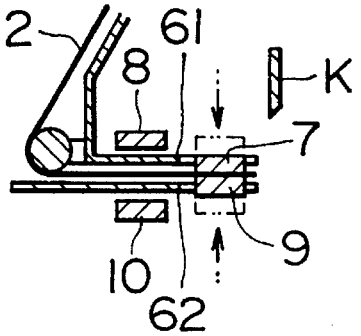
FIG. 12 is a schematic view showing the leading edge of the film held by a film holding plate portion.
Figure 13:
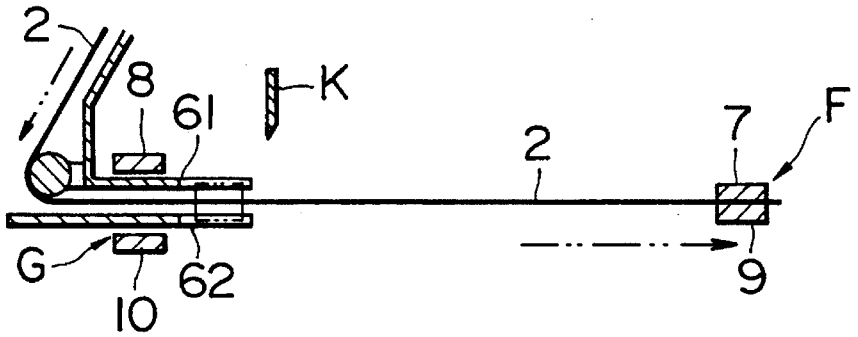
FIG. 13 is a schematic view showing the state where the film is drawn by a specified length.

The carrying base C is moved downwardly of the packing section B by the horizontally operating section D1 in the state of being held in its height for carrying the article 1 to a specified position under the packing section B (see FIG. 8). At the same time when this carrying operation for the article 1 is performed, as shown in FIG. 12, the leading edge of the film 2 held between the film holding plates 61 and 62 is clamped by the front gripper F. The front gripper F starts the drawing operation of the film 2 by the operation of the transfer mechanism P1, and draws the film 2 in the direction of the packing section B by a specified length corresponding to the size of the article 1 (see FIG. 13). At this time, the rear gripper G stands by on the rear side of the film holding plates 61 and 62, that is, it is positioned so as not to obstruct the movement of the front gripper F of holding the leading edge of the film 2.

Figure 14:
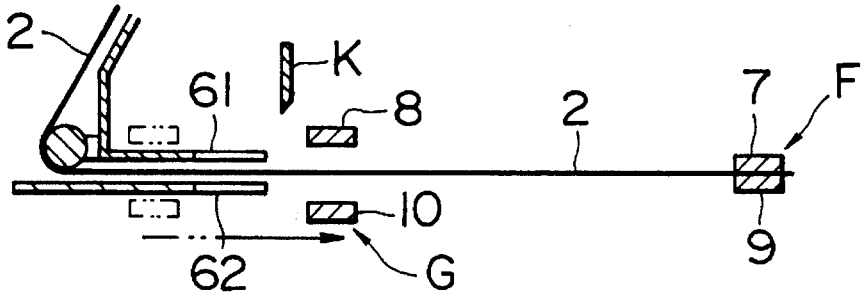
FIG. 14 is a schematic view showing the state where a rear gripper is moved before a cutter.
Figure 15:
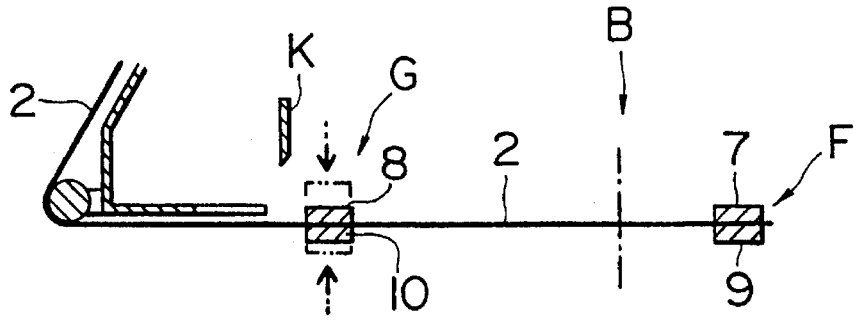
FIG. 15 is a schematic view showing the state where the film is held by the rear gripper.

Next, the rear gripper G standing-by on the rear side of the film holding plates 61 and 62 advances up to the position in front of the cutter K, and holds the rear portion of the film 2 extending by the specified length (see FIGS. 14 and 15).

Figure 16:
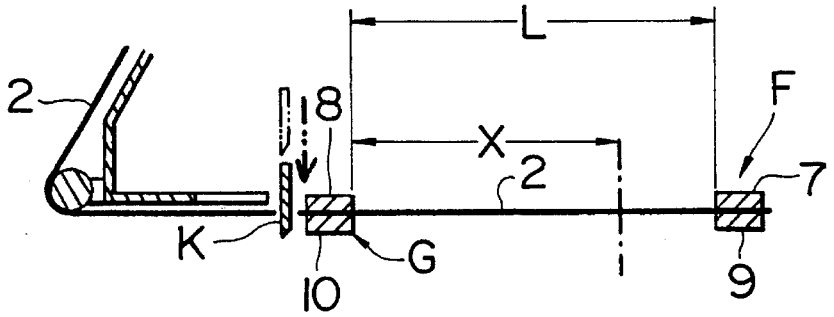
FIG. 16 is a schematic view showing the state where the film is cut by the cutter.

After that, the film 2 is cut in the back of the rear gripper G by the cutter K (see FIG. 16). Thus, the cut-film 2 is in the state where the front and rear edge portions are held by the front and rear grippers G and F opposed to each other with an interval L (see FIG. 16). Further, the rear gripper G is kept to be spaced from the center of the packing section B by a distance X.

Figure 17:
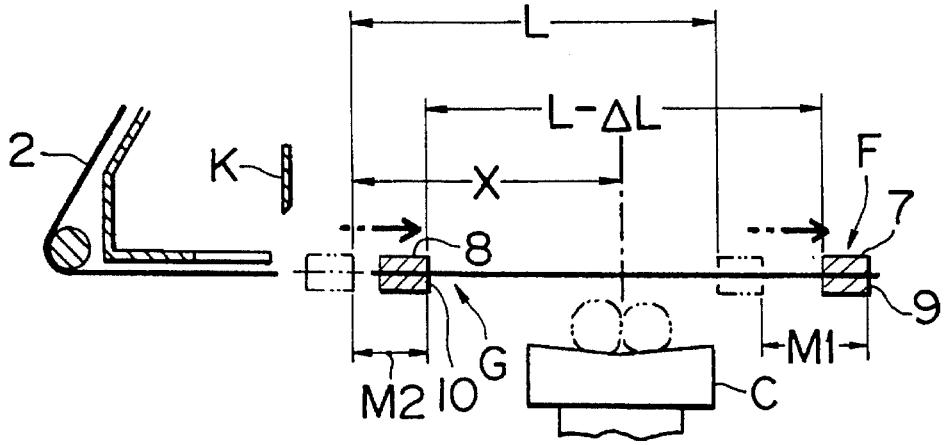
FIG. 17 is a schematic view showing the state where the film held by the front and rear grippers is subjected to the centering with respect to the packing section.

After the film 2 is cut, the transfer mechanisms P1 and P 2 are operated with a specified timing, so that the front gripper F and the rear gripper G are moved over the packing section B by specified amounts M1 and M2 with the synchronous speed, and are stopped thereat (see FIG. 17).

In the process that the front and rear grippers F and G are moved, the interval L between both the grippers F and G is increased to be $(L+\Delta L)$. Accordingly, the film 2 held between both the front and rear grippers F and G is stretched by a specified amount of $\Delta L$. At the same time, the center of the stretched film 2 is made to correspond to the center of the carrying base C moved to the packing section B, thus performing the centering of the film 2. In addition, a movement amount M1 of the front gripper F is calculated by an equation of $(X-L/2)+\Delta L/2$, while a movement amount M2 of the rear gripper G is calculated by an equation of $(X-L/2)-\Delta L/2$.

Namely, the stretched amount of the film 2 can be freely adjusted by changing the setting of the movement amounts M1 and M2 of both the grippers F and G for increasing or decreasing the value of $\Delta L$ being the movement difference between both the grippers F and G.

Additionally, in the above embodiment, the operation for generating the stretched amount of the film 2 held between both the front and rear grippers F and G, that is, the movement difference ($\Delta L$) between both the front and rear grippers F and G is performed during movement of both the grippers F and G; however, the timing for generating the difference between both the grippers F and G may be performed before-or after the centering operation. Further, the above timing for generating the difference ($\Delta L$) may be performed as follows: namely, both the front and rear grippers F and G are moved by an amount of $(X-L/2)$, being stopped once after centering of the film 2, and moved forward or rearward by the amount of ΔL/2, respectively.

Namely, the provision of the distance (ΔL) is not limited insofar as the front gripper F is apart from the rear gripper G by the distance (ΔL) before the article 1 is supplied to the packing section B.

Figure 18A:
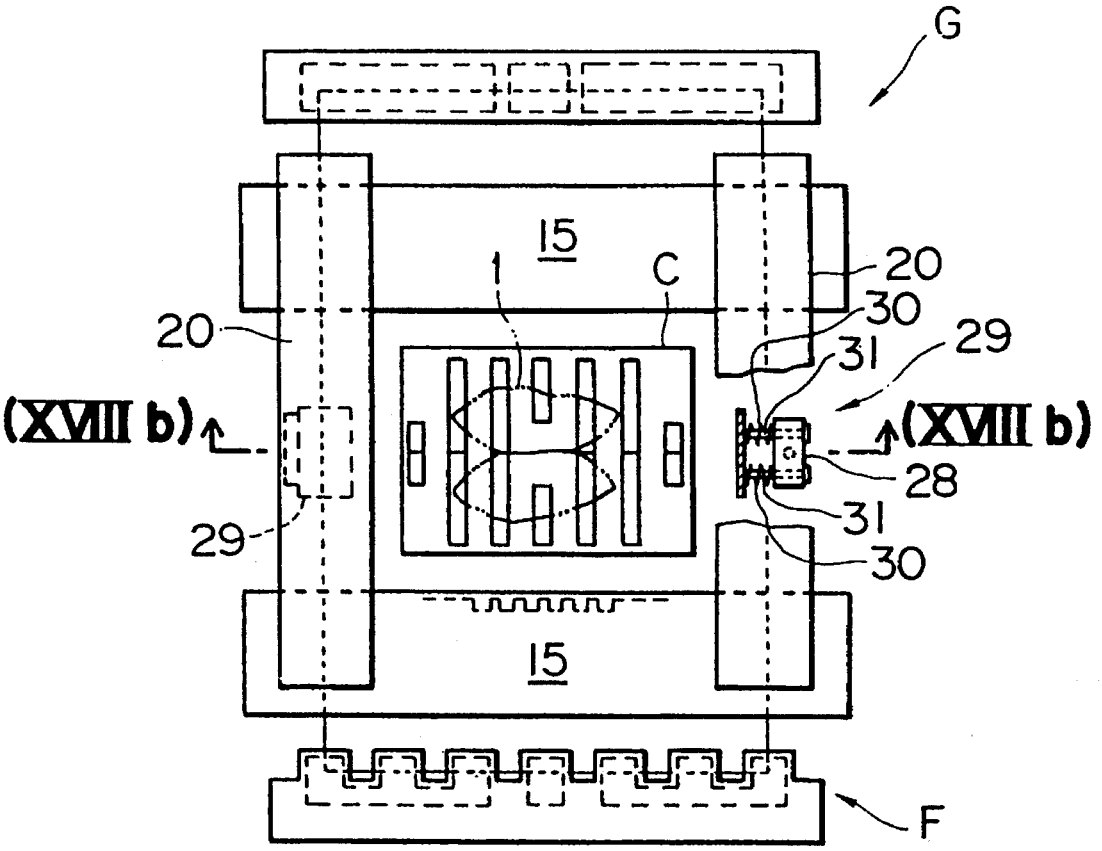
FIGS. 18(*a*) and 18(*b*) are schematic views showing the right and left folding apparatuses in the state where the right and left side edges of the film are held; wherein FIG. 18(*a*) is a plan view.
Figure 18B:
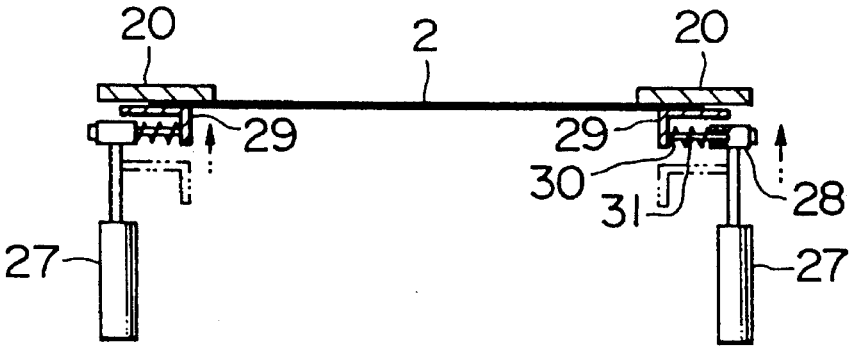
Figure 19A:
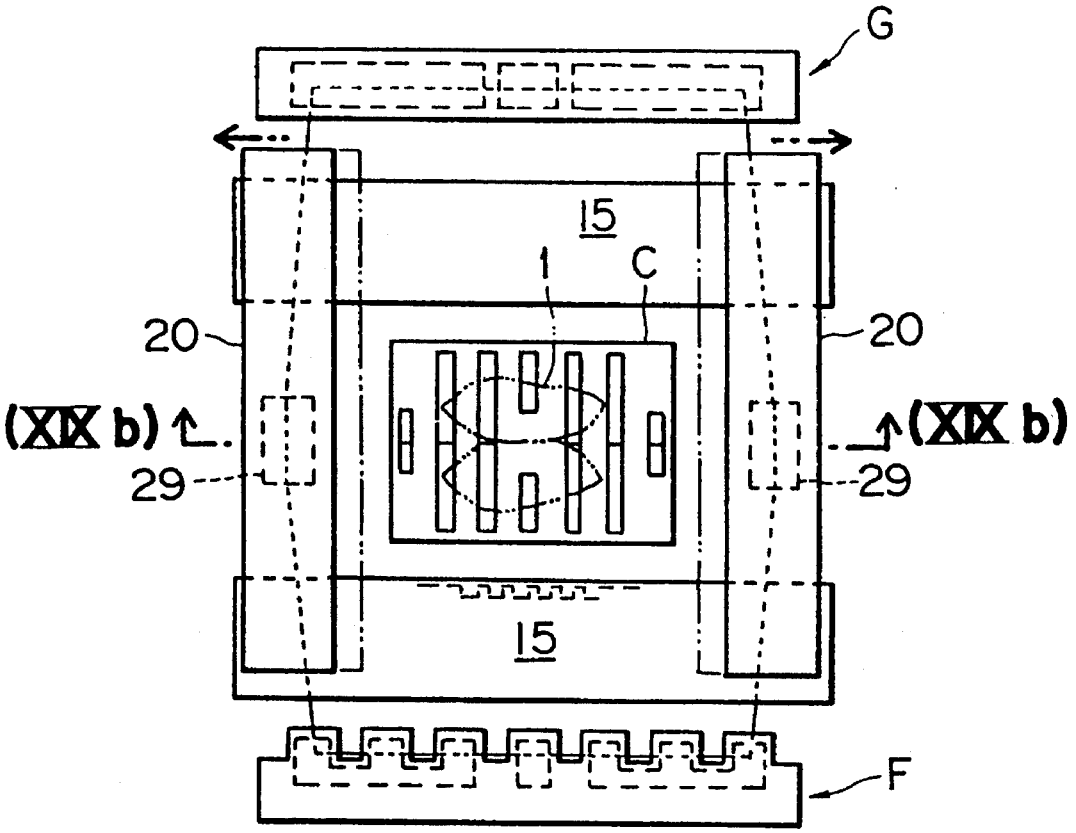
FIGS. 19(*d*) and 19(*b*) are schematic views showing the right and left folding apparatuses in the state where the film is stretched in the right and left; wherein FIG. 19(*a*) is a plan view.
Figure 19B:
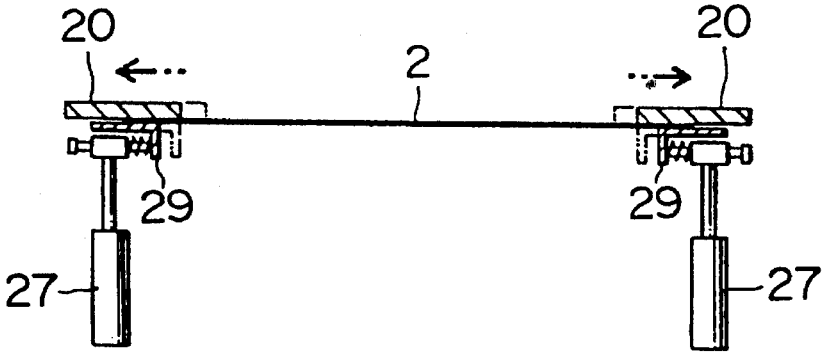
Figure 20:
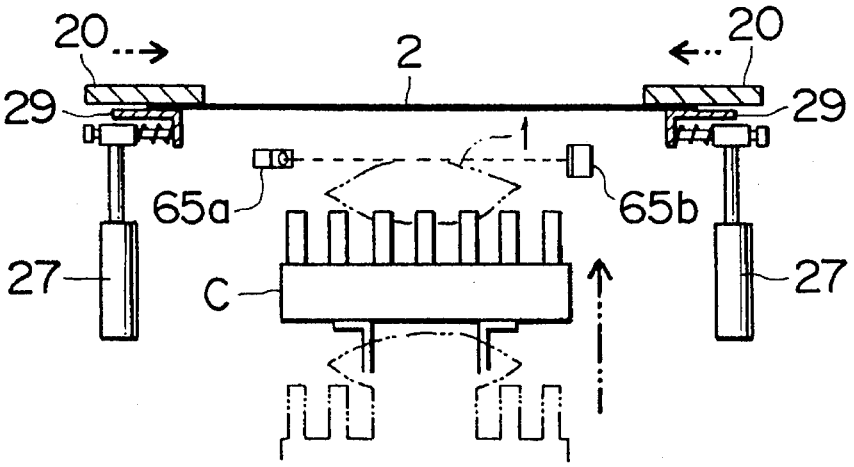
FIG. 20 is a schematic view of the packing section showing the process of ascending the carrying base.
Figure 21:
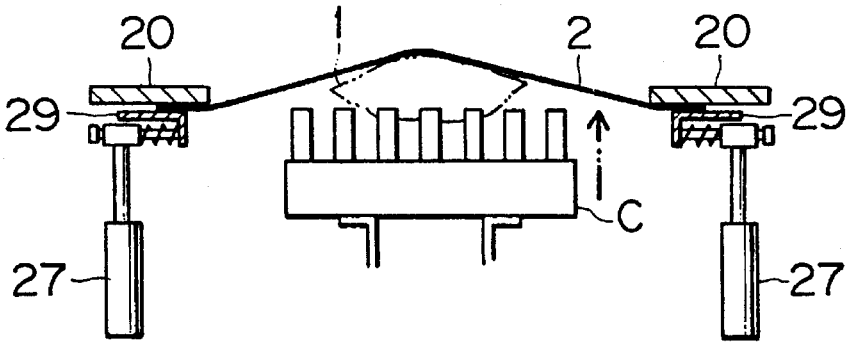
FIG. 21 is a schematic view of the packing section showing the state where the film is pushed up by the article.

After that, as shown in FIG. 18, the right and left side edges of the film 2 are held by the movable clamping plates 29 of the right and left clamping apparatuses H and the right and left folding plates 20, and are then extended in the width (right and left) direction by a specified amount as shown in FIG. 19. As a result, the film 2 drawn at the packing section B is held at the leading edge, tailing edge and the right and left side edges in such a state as to be extended by pre-stretching.

On the other hand, the carrying base C moved to the position under the packing section B is, as shown in FIG. 9, ascended to the film 2 which is extended at the packing section B, by operation of the vertically operating section D2, thus supplying the article 1 to the packing section B.

In the process that the article 1 is ascended, the upper portion of the article 1 placed on the carrying base C passes through photoelectric sensors 65*a* and 65*b* disposed at a specified height under the packing section B. At this time, the photoelectric sensors 65*a* and 65*b* output detecting signals, and on the basis of the detecting signals, the right and left folding plates 20 are slightly moved to the inner sides to give a suitable loosening to the film 2 (see FIG. 20).

Figure 22:
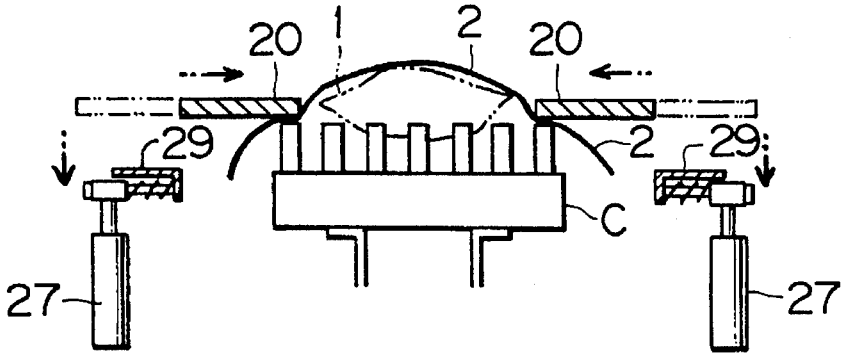
FIG. 22 is a schematic view of the packing section showing the state where the right and left sides of the film are released.

Directly after the loosening of the film 2, the film 2 is pushed up by the article 1 from the bottom (see FIG. 21), and concurrently the right and left folding plates 20 of the right and left folding apparatuses J are started to be moved (see FIG. 22), and further, the movable clamping plates 29 supported by the air cylinders 27 are separated from the right and left folding plates 20, to release the right and left side edges of the film 2 (see FIGS. 10 and 22).

Figure 23:
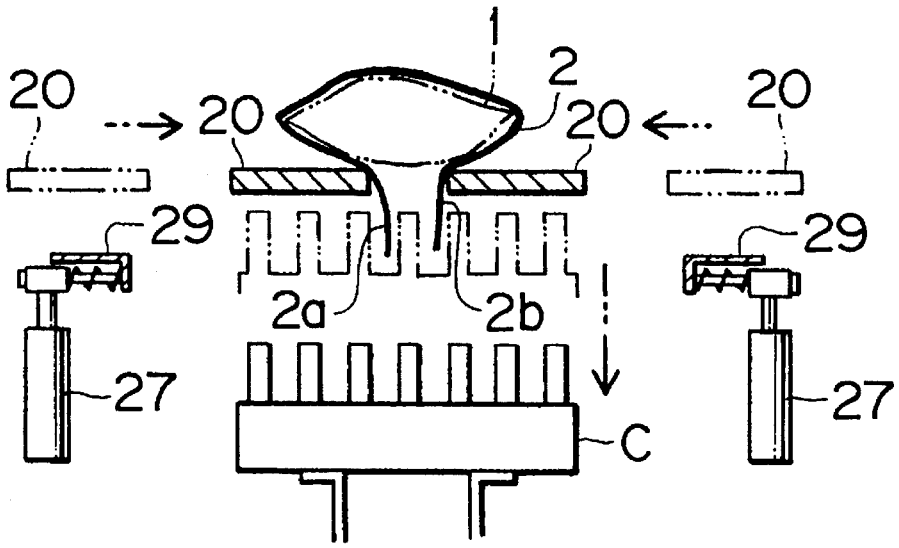
FIG. 23 is a schematic view of the packing section showing the state where the right and left folding apparatuses are closed.
Figure 24:
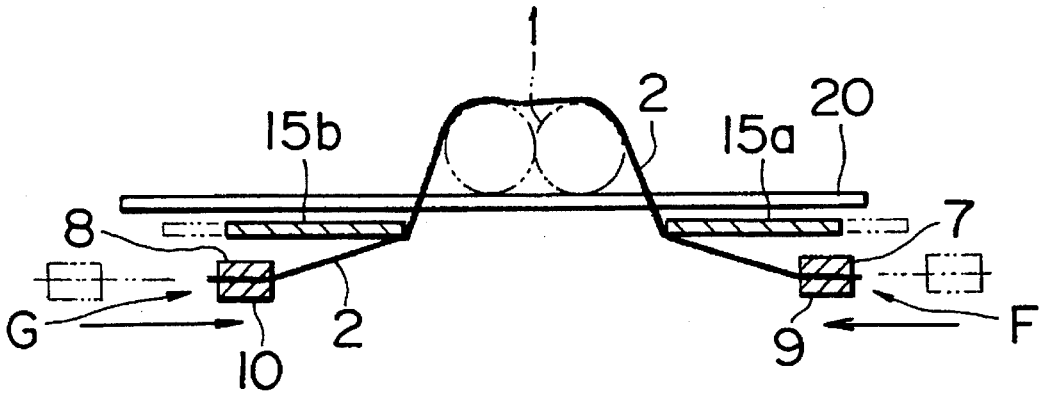
FIG. 24 is a schematic view showing the state where the front and rear grippers are moved as accompanied by the closing of the front and rear folding plates.
Figure 25A:
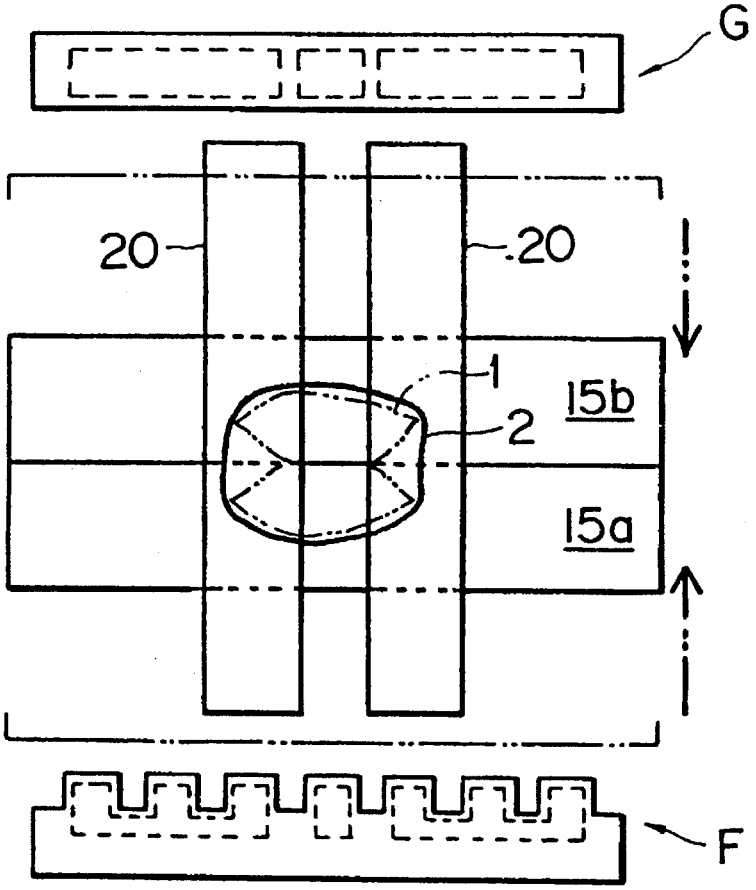
FIGS. 25(*a*) and 26(*b*) are schematic views of the packing section showing the state where the front and rear folding plates are closed; where FIG. 25(*a*) is a plan view.
Figure 25B:
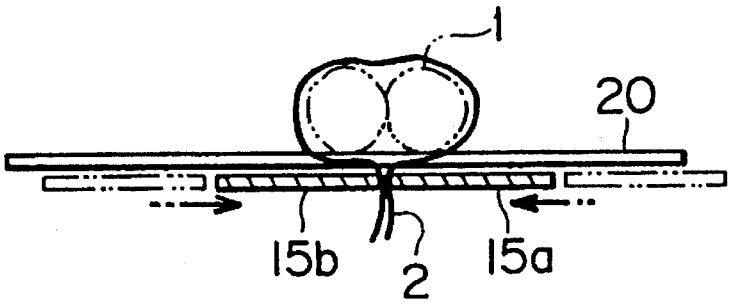
Figure 26:
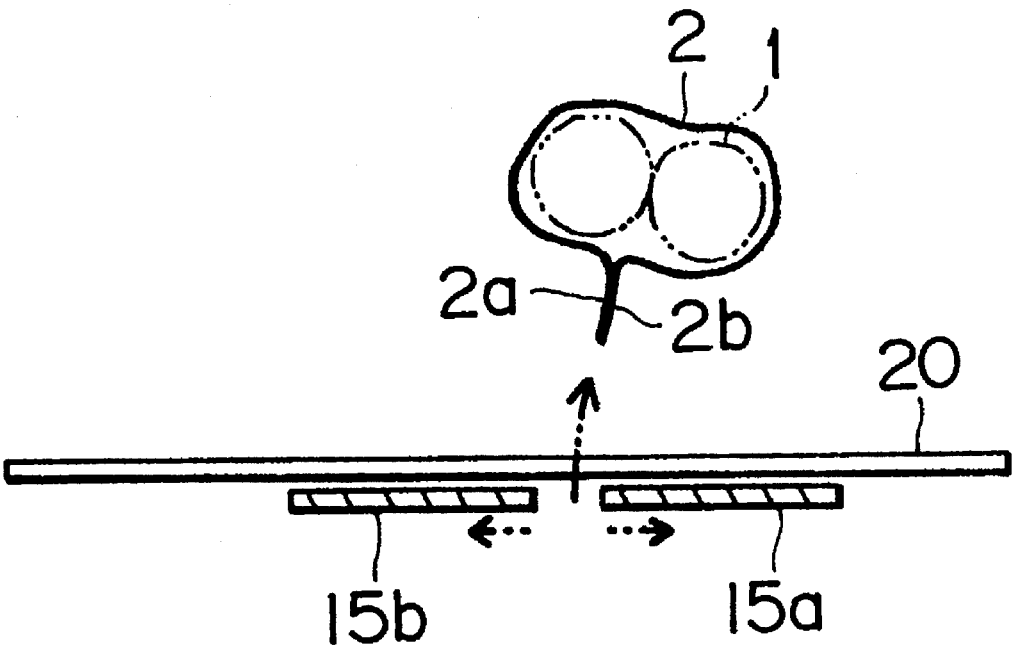
FIG. 26 is a schematic view of the packing section showing the state where the article is taken up.

Further, the right and left folding plates 20 are moved to the center, and are stopped at the position slightly apart from the central portion of the bottom surface of the article 1 (see FIG. 23). At the same time, approximately, the front and rear folding plates 15*a* and 15*b* are started to be moved in the folding direction, and as accompanied therewith, the front and rear grippers F and G are moved in the direction of being closed to each other (see FIGS. 11 and 24), wherein the timing of releasing the film 2 by both the grippers F and G is based on the size of the article 1.

The front and rear folding plates 15*a* and 15*b* are continuously moved after the grippers F and G release the holding of the film 2, and finally the folding edges 70*a* and 70*b* are abutted on each other and subjected to the heat seal by the heater 19 (see FIG. 11 and 25), thus completing the packing of the article 1.

In such a state that the article 1 already packed is placed on the folding plates 15*a* and 15*b*, the light irradiated from the sensor 80 to the reflection plate 81 is shielded by the article 1, so that the sensor 80 is made in the on-state. The on-state of the sensor 80 is kept insofar as the article 1 is not removed from the front and rear folding plates 15*a* and 15*b* by the operator.

The operator removes the packed article 1 from the upper surfaces of the front and rear folding plates 15*a* and 15*b* (see FIG. 26), and takes up the label 66 issued from the label printer 64 by hand and sticks it on the article 1. At this time, the sensor 80 is made in the off-state by removal of the article 1, and the enabling signal for the starting of the next packing operation is outputted.

As the sequential packing operations described above are completed, the carrying base C, and the front gripper F and the rear gripper G are returned to the original stand-by positions, after which the same operations are repeated, to thus perform the packing of the articles 1.

Additionally, in the above embodiment, the carrying base C is ascended from the position under the carrying-in section A such that the upper surface thereof is positioned higher than the upper surface of the carrying-in section A, so that the article 1 is supplied from the carrying-in section A to the carrying base C; however, the supplying manner from the carrying-in section A to the carrying base B is not limited to the above construction. The essential thing lies in that the article 1 is supplied from the carrying-in section A to the carrying base B by positioning the upper surface of the carrying base B higher than the surface of the carrying-in section A. Accordingly, in place of ascending of the carrying base C, the carrying-in section A may be so constructed as to be vertically moved and to be descended. In this case, an elevating mechanism 5A for vertically moving the carrying-in section A is newly required as compared with the above embodiment; however, it may achieve the intended object.

As described above, according to the present invention, the article 1 carried and placed on the carrying-in section A is supplied to the upper surface of the carrying base C; the carrying base C is moved to the packing section where the film 2 is drawn and stretched, and the article 1 is carried and supplied to the packing section B. Thus, it is possible to carry the article to the packing section for packing without any damage not only in the packing form of no-tray system but also in the packing form of tray system. Accordingly, it is possible to provide the packing method and the packing apparatus effective for the packing form of no-tray system.

Since the article 1 can be carried from the carrying-in section A to the packing section B only by operation of the carrying base C, it is possible to eliminate the complicated apparatus for carrying the article to the position under the packing section and the enlarged carrying conveyor as conventional, and hence to extremely simplify the structure of the apparatus and miniaturize the size thereof.

Since the carrying-in section A is connected to the weighing meter 5, that is, the carrying-in section B has the weighting function, it is possible to perform the weighing of the article by placing the article on the carrying-in section, and hence to make easy the weighing of the article and reduce the load of the operator.

The right and left side edges of the film 2 drawn at the specified position of the packing section B are held by press-contacting the movable clamping plates 29 disposed under the right and left folding plates 20 or in the vicinity thereof with the lower surfaces of the right and left folding plates in cooperation with the right and left folding plates. Further, when the right and left folding plates 20 are moved in the direction of being separated from each other, the right and left movable clamping plates 29 are synchronously moved in the direction of being separated from each other together with the right and left folding plates 20, so that the film is pre-stretched in the width direction by the specified amount. Accordingly, the right and left clamping apparatuses H having the function of holding the right and left side edges of the film and of prestretching the film in the width direction by the specified amount are reduced in the number of parts as compared with the prior art apparatus, which makes it possible to extremely simplify the structure, and hence to simplify the apparatus. This makes it possible to reduce the production cost, to miniaturize the size, and to lower the height of the packing section resulting in the enhanced workability.

Further, the film 1 can be drawn to the packing section B at the height level where the right and left folding plates 20 are disposed movably in the direction of being separated from or closed to each other, it is possible to eliminate the gap between the film drawn to the packing section and the right and left folding plates. Accordingly, it is possible to lower the amount of projecting movement of the vortex of the article after the contact with the film as compared with the prior art apparatus, and to keep the holding state of the right and left side edges of the film by-the right and left clamping apparatuses directly before the right and left folding plates fold the right and left side edges of the film under the bottom portion of the article. This makes it possible to pack the article in the beautiful and preferable packing form of the stretched amount with suitable tension and strength of eliminating the loosening of the film and any wrinkling. Consequently, since the packing is performed with the stretched amount with suitable tension and strength, the present invention is effective for the so-called packing form of no-tray system for packing a plurality of articles (bulk) without any tray.

Since the cut-film held between the front and rear grippers F and G is moved to the packing section on which the article is placed, and the centering between the packing section B and the cut-film 2 is performed, even when the size of the cut-film 2 is changed according to the size of the article 1, it is possible to obtain the preferable finish of the packing by making the folding allowance in the front and rear sides of the film for wrapping the article in the same dimension, and hence to enlarge the size of the packable article.

Even a small sized article can be packed with the film having the optimum length for the size of the article, so that it is possible to prevent the waste of the film.

Further, along with the centering of the cut-film 2, the pre-stretching in the longitudinal direction of the film is performed by drawing the film 2 held between the front and rear grippers by utilizing the movement difference between the front and rear grippers, it is possible to perform the strong pre-stretching for the film, and to freely adjust the stretched amount by changing the movement difference between the front and rear grippers F and G.

Accordingly, it is possible to perform the beautiful packing for the article by the pre-stretching.

Further, the pre-stretching is performed by utilizing the transfer mechanisms of the front and rear grippers for performing the centering the film, which causes an advantage of making unnecessary the special construction for performing the pre-stretching.

In addition, the heater 19 for fusing the edges of the film finally folded under the bottom portion of the article 1 is provided on the folding edge 70*a* of the folding plate 15*a* which finally perform the folding operation, wherein the heater is not a face-heating type but a line-heating type, and instantaneously generates heat. Accordingly, not only in the tray article but also in the no-tray article, it is possible to fuse the edges of the film such that the edges finally folded under the bottom portion of the article are not peeled, without heating the article.

Accordingly, by effectively using the folding means, for a no-tray article and a tray article, the treatment of fusing the film edges can be performed at the packing section by the common treatment means, which eliminates respective auxiliary apparatuses such as carrying conveyors for the no-tray article and the tray article which are necessary for the prior art apparatus, to thereby eliminate the installation spaces thereof. Therefore, it is possible to extremely reduce the number of parts as compared with the prior art apparatus, to simplify the structure, and to achieve the miniaturization of the apparatus and reduce the production cost.

Further, since the heater is formed in a corrugated shape along the folding edge formed in the corrugated shape, it is possible to absorb and relax the extension (thermal expansion change) of the heater by the corrugated recessed portion, and hence to reduce the load stress due to the expansion. This makes it possible to prevent the breaking of the heater.

In addition, since the detecting means 80 for detecting whether or not the packed article 1 is removed from the packing section B, and on the basis of the detected result, the next packing operation is allowed to be started, the operator takes up the article after perfectly completing of the packing at the packing section B. This makes it possible to eliminate the necessity of assembling the carrying-out means such as conveyor or the like just as the prior art packing apparatus, and hence to simplify the structure, miniaturize the size, and reduce the production cost.

Figure 27:
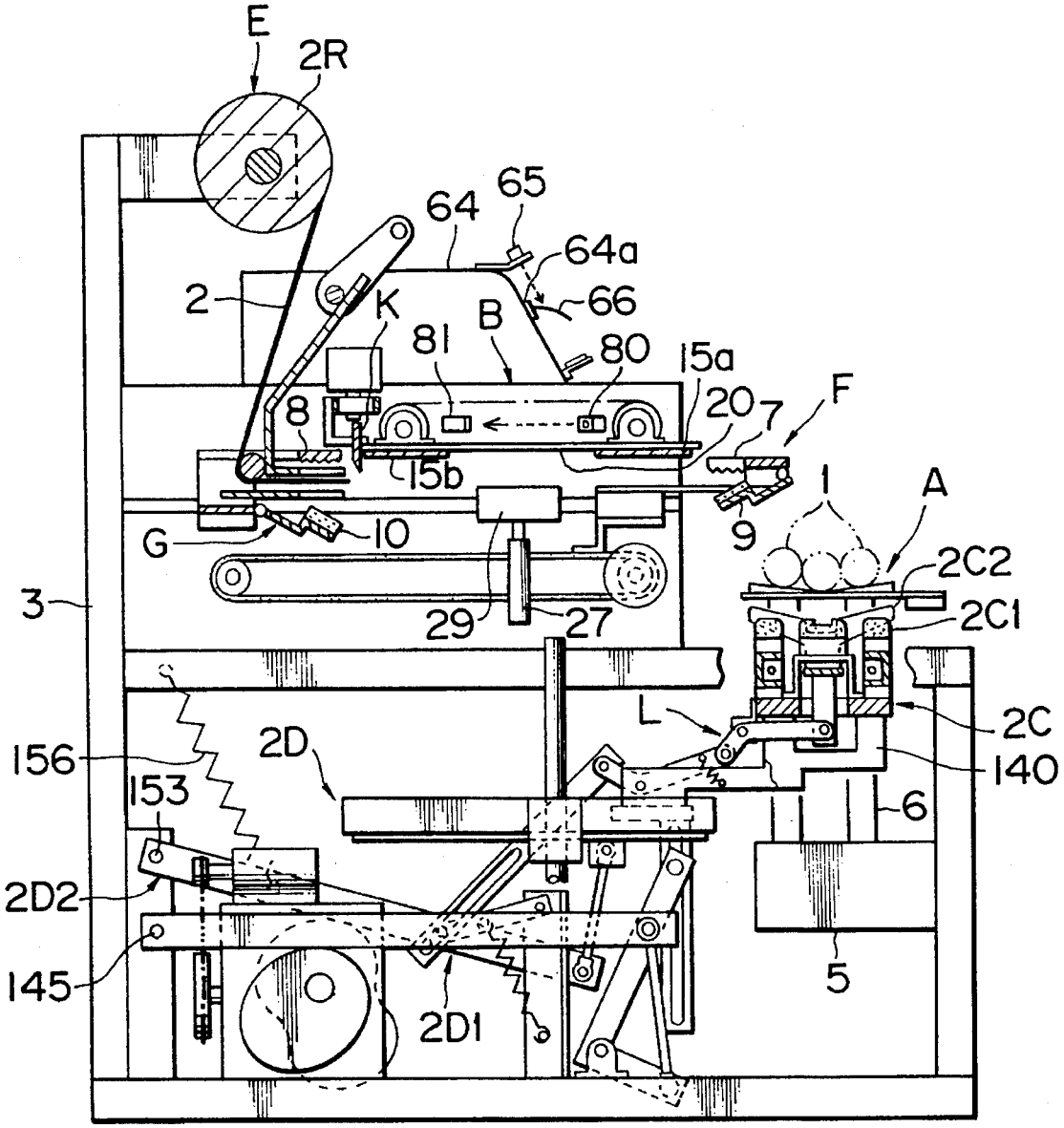
FIG. 27 is a side view of the packing section showing another embodiment of a carrying base.

Next, another embodiment for improving the carrying base C as shown in the above embodiment will be described with reference to FIGS. 27 to 39. FIG. 27 shows this embodiment having the same construction as in the above embodiment except for a carrying base 2C and its drive means 2D and L. In this figure, the same parts as in the above embodiment are indicated at the same reference numerals, and the explanation thereof is omitted.

The carrying base 2C is supported on the drive mechanism 2D through supporting members 135 described later, which is disposed movably within a machine casing 3 in the horizontal and the vertical directions by operation of the drive mechanism 2D. The carrying base 2C receives an article 1 placed on a carrying section A from the carrying-in section A, carries it to the position under the packing section B, and pushes-up the article 1 to a film 2 of the packing section B from the bottom.

Figure 29:
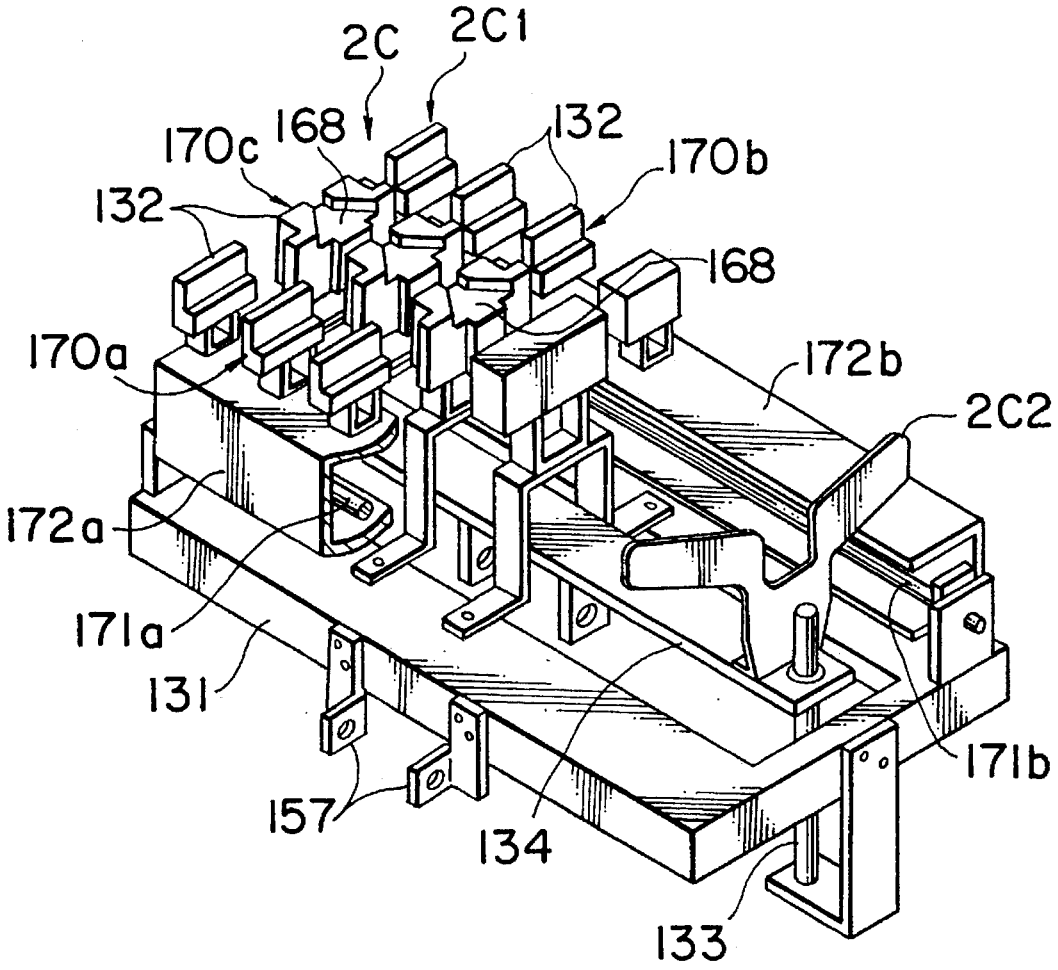
FIG. 29 is a perspective view showing the carrying base.

As shown in FIG. 29, the carrying base 2C includes first receiving portions 2C1, each having an approximately flat upper surface, which are juxtaposed in one direction with intervals capable of passing through the intervals between comb-like placing levers 4 constituting the carrying-in section A, and which are adapted to receive the article 1; and second receiving portions 2C2, each having an upper surface of a recessed shape being gradually inclined toward the central portion, which are disposed vertically movably between respective first receiving portions 2C1 and are adapted to receive the article 1.

The first receiving portions 2C1 includes receiving groups 170*a* and 170*b* juxtaposed along both long sides of a head base 131 formed in a rectangular shape in a plan view with the above intervals so as to be freely tilted and raised; and central receiving group 170*c* juxtaposed between the both side receiving groups 170*a* and 170*b* with the same intervals so as to be freely tilted and raised. Further, placing portions 132 of these receiving groups on which the article is placed are formed of elastic material for preventing the article from being damaged. In addition, the upper surface of each placing portion 132 is formed to be flat. Each of the receiving groups is held in the raised posture by a spring (not shown), and is suitably tilted in the longitudinal and lateral folding directions against the spring when front and rear folding plates 15*a* and 15*b* and right and left folding plates 20 collide or are contacted with each other; and is automatically returned to the raised posture by releasing of the collision or the contact state of the front and rear folding plates 15 and the right and left folding plates 20. Specifically, the both side receiving groups 170*a* and 170*b* are erected on supporting bases 172*a* and 172*b* turnably mounted on supporting shafts 171*a* and 172*b* on the head base 131, and the supporting bases 172*a* and 172*b* are restricted in the rotation so as to hold the raised states of the both side receiving groups 170*a* and 170*b* by the springs (not shown). When the front and rear folding plates 15 collide or are contacted with the receiving groups 170*a* and 170*b*, the supporting bases 172*a* and 172*b* are turned against the springs, so that the receiving groups 170*a* and 170*b* are tilted in the direction of the central receiving group 170*c*. Further, the both side receiving groups 170*a* and 170*b* are mounted to the supporting bases 170*a* and 170*b* so as to be tilted to the center of the long side direction of the head base 131. The both side receiving groups 170*a* and 170*b* are restricted in the tilting to hold the raised state by the springs (not shown), and when the right and left folding plates 20 collide and are contacted with the receiving plates 170*a* and 170*b*, the both side receiving groups 170 and 170*b* are tilted against the springs. In addition, the central receiving group 170*c* is restricted in the tilting to hold the raised state by the springs (not shown), and when the right and left folding plates 20 collide and are contacted with the receiving plates 170*c*, the central receiving portion 170*c* is tilted against the springs. Then, when the front and rear folding plates 15 and the right and left folding plates 20 are opened and returned, the both side receiving groups 170*a* and 170*b* and the central receiving group 170*c* are automatically returned to the raised postures by the energizing force of the springs.

Figure 28:
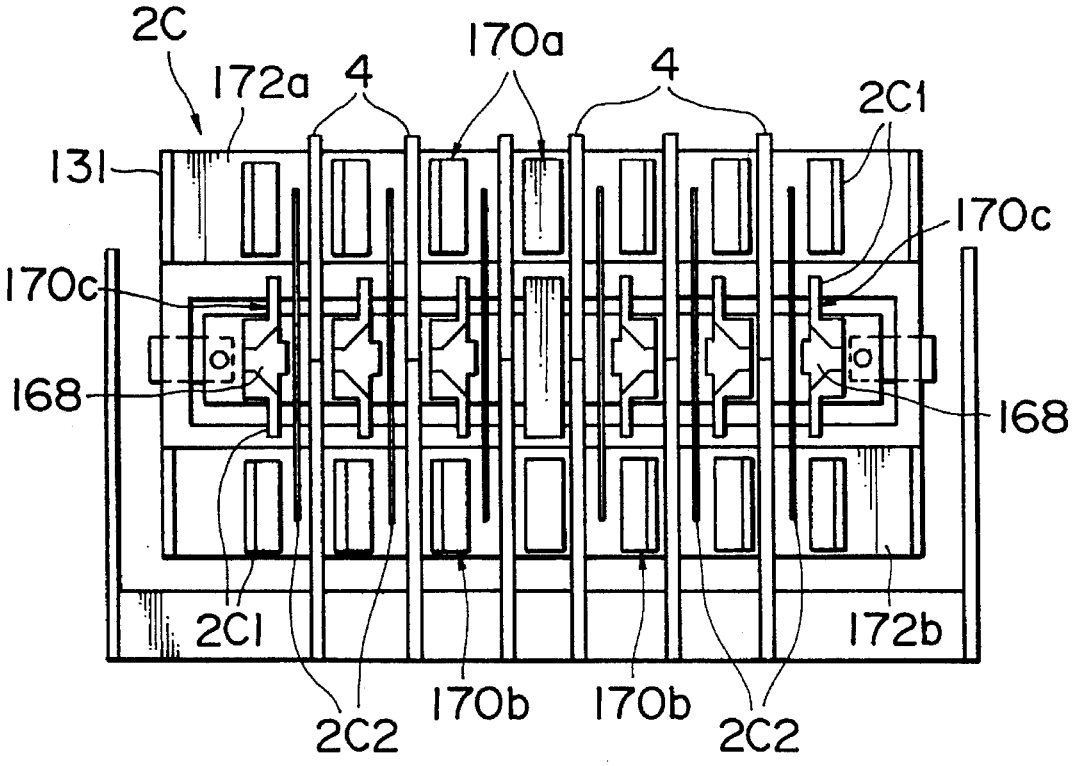
FIG. 28 is a plan view showing the state where the carrying base is positioned under the carrying-in section.

In addition, as shown in the figure, the upper surface of each first receiving portion 2C1 constituting the central receiving group, has a recessed portion 168 for preventing the rolling of a round article liable to be rolled such as lemon or orange (see FIGS. 28 and 29).

On the other hand, the second receiving portions 2C2 have a function to hold a plurality of the articles (bulk) received from the carrying-in section A in such a manner as not to be disturbed in the alignment and to be rolled out during they are carried from the carrying-in section A to the packing section B.

Each of the second receiving portions 2C2 is formed by a method wherein a metal sheet is cut approximately in a T-shape, and the upper surface (upper side) thereof is gradually inclined toward the central portion to be thus formed in a recessed shape. The second receiving portions 2C2 are fixedly supported at the lower end thereof by an elevating member 134 which is disposed so as to be vertically movably supported over guide columns 133 erected on both sides of the short side direction at the central opening of the head base 131 (see FIGS. 29 and 30), and are erected at the positions not to interfere with the placing levers 4 of the carrying-in section A between respective first receiving portions 2C1 (see FIG. 28).

In addition, the portion of the second receiving portion 2C2 contacted with the article is covered with soft material for preventing the article from sliding or being damaged.

The elevating member 134 for vertically movably supporting the second receiving portions 2C2 between respective first receiving portions 2C1 is connected to an elevating mechanism L described later. Thus, in receiving the article 1 from the carrying-in section A and carrying it to the position near the packing section B, the upper surfaces of the second receiving portions 2C2 are projectingly ascended higher than the upper surfaces of the placing portions 132 of the first receiving portions 2C1, and are sunk lower than the upper surfaces of the placing portions 132 of the first receiving portions 2C1 with the timing that the article 1 is ascended to push-up the film 2 and the upper surface of the article 1 is covered with the film 1.

The drive mechanism 2D is provided on the bottom portion within the machine casing 3 to move the carrying base 2C from the carrying-in section A to the packing section B. It includes a horizontally operating section 2D1 for horizontally moving the carrying base 2C supported by the supporting member 135 between the carrying-in section A and the packing section B; and a vertically operating section 2D2 for vertically moving the carrying base 2C at respective positions between the carrying-in section A and the packing section B.

The supporting member 135 includes guide columns 136 erected such that the lower ends are fixed on both the side bottom portions of the machine casing 3; a vertically moving frame 137 framed in a rectangular shape in a plan view which is horizontally disposed within the machine casing 3 such that both the side frame portions are vertically movably supported between both side guide columns 136; and a longitudinally moving plate 139 internally supported within the moving frame 137 so as to be slidable in the longitudinal direction such that both the side portions are locked to guide grooves 138 provided on the inner surfaces of both the side frames of the vertically moving frame 137. The head base 131 for the carrying base 2C is fixed on the front portion of the upper surface of the longitudinally moving plate 139 through supporting legs 140 being L-shaped in a side view. In addition, the carrying base 2C is capable of entering under the carrying-in section A by the supporting legs 140 unless the length of the supporting levers 6 is not longer so much (see FIG. 27).

The horizontally operating section 2D1 includes a cam A144 mounted to a cam shaft 143 connected to a main motor 142 provided on the bottom portion of the machine casing 3 through a gear reduction box 141 containing a gear mechanism, that is, a gear reduction mechanism; a rocking arm A146 connected to the cam A144 to vertically rock the front end, that is, the rocking end around a rear end rotatably supporting portion 145 by the cam A144; a starting arm 149 is approximately L-shaped in a side view and is mounted at the angular portion to a rotating shaft 147 installed on the bottom portion of the machine casing 3 for rotatably connecting the rocking end of the rocking arm A146 to the short side end portion through the connecting arm A148; and a vertical arm 151 fixedly hung from the lower surface of the longitudinally moving plate 139 of the supporting member 135, wherein the long side end portion of the stating arm 149 is slidably engaged with a connecting slot 150 formed throughout the whole length of the hung portion.

Figure 36:
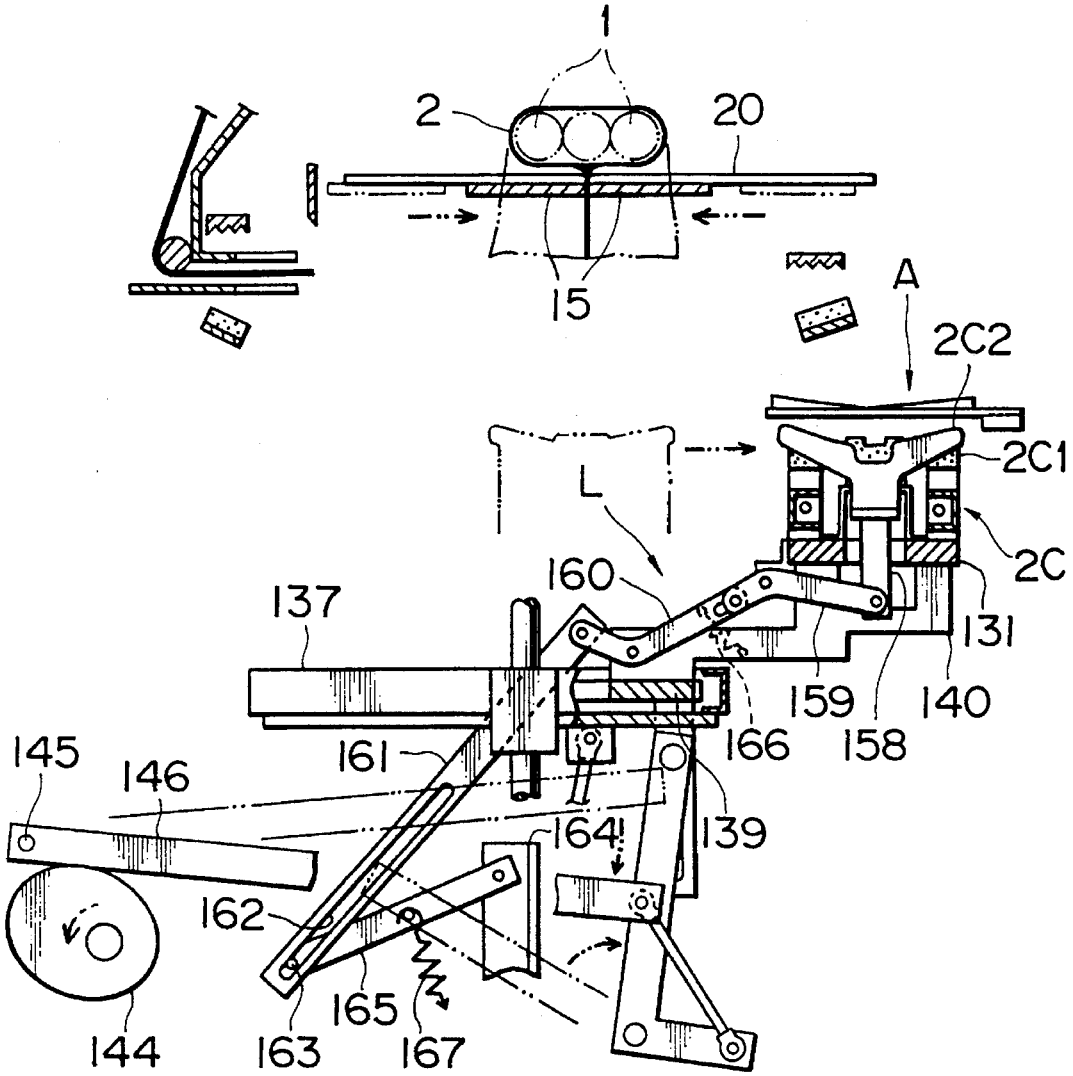
FIG. 36 is a schematic view showing the state where the carrying base is returned from the position under the packing section to the position under the carrying-in section.

The long side of the starting arm 149 is longitudinally moved around the rotating shaft 147 by the vertical rocking operation of the rocking arm A146 along the cam floor of the cam A144 turned by the main motor 142, so that the carrying base 2C is moved from the carrying-in section A to the position under the packing section B through the longitudinally moving plate 139 (from the state in FIG. 31 to the state in FIG. 32), and moved from the position under the packing section B to the carrying-in section A (the state in FIG. 36).

On the other hand, the vertically operating section 2D-2 includes a cam B152 mounted to the cam shaft 143; a rocking arm B154 connected to the cam B152 for vertically rocking the front end side, that is, the rocking end around a rear end rotatably supporting portion 153 by the cam B152;

and a connecting arm B155 with the end portions rotatably connected to the rocking end of the rocking arm B154 and the vertically moving frame 137 of the supporting member 135.

Thus, the carrying base 2C is vertically moved at respective positions between the carrying-in section A and the packing section B through the vertically moving frame 137 by the vertically rocking operation of the rocking end of the rocking arm B154 along the cam floor of the cam B152 turned by the main motor 142.

Figure 31:
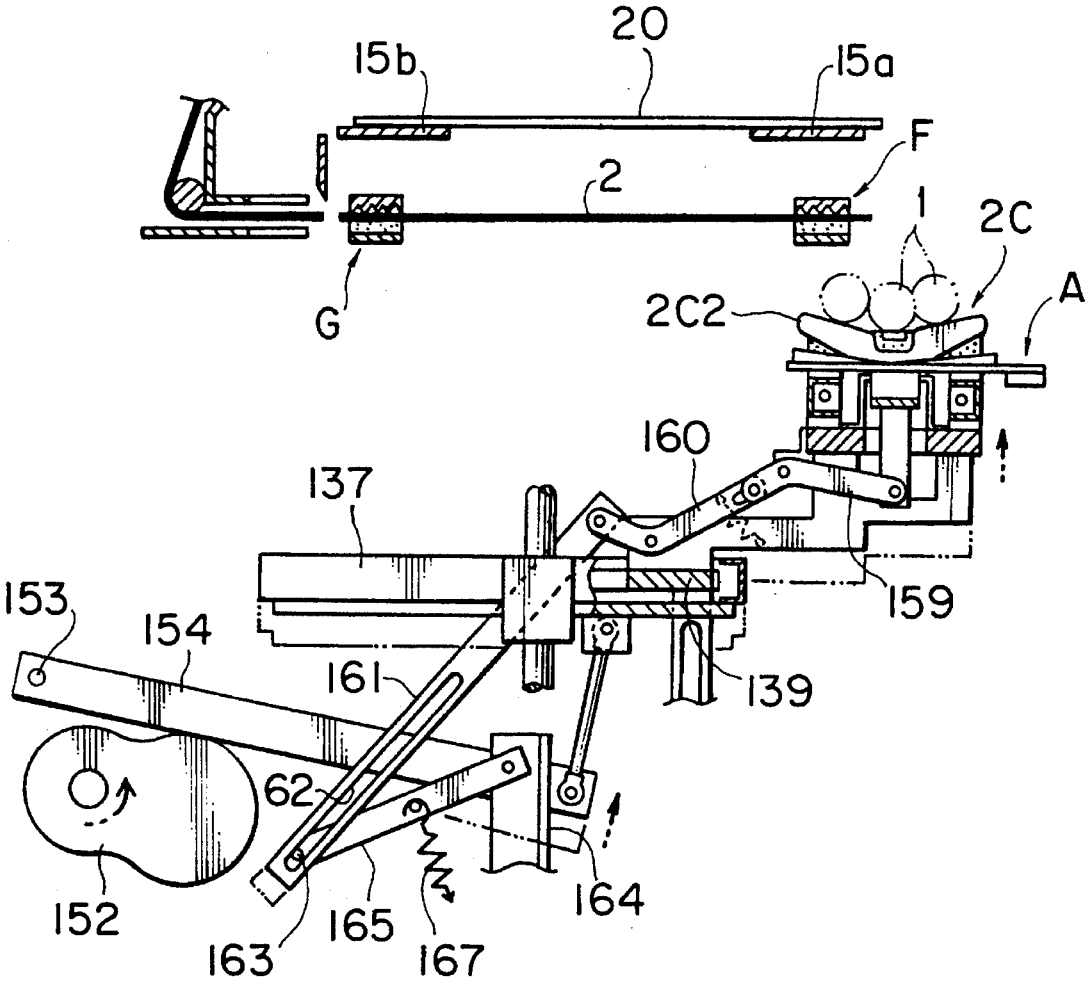
FIG. 31 is a schematic view showing the state where the carrying base is vertically ascended from the position under the carrying-in section and receives the article on the second receiving portions from the carrying-in section.
Figure 32:
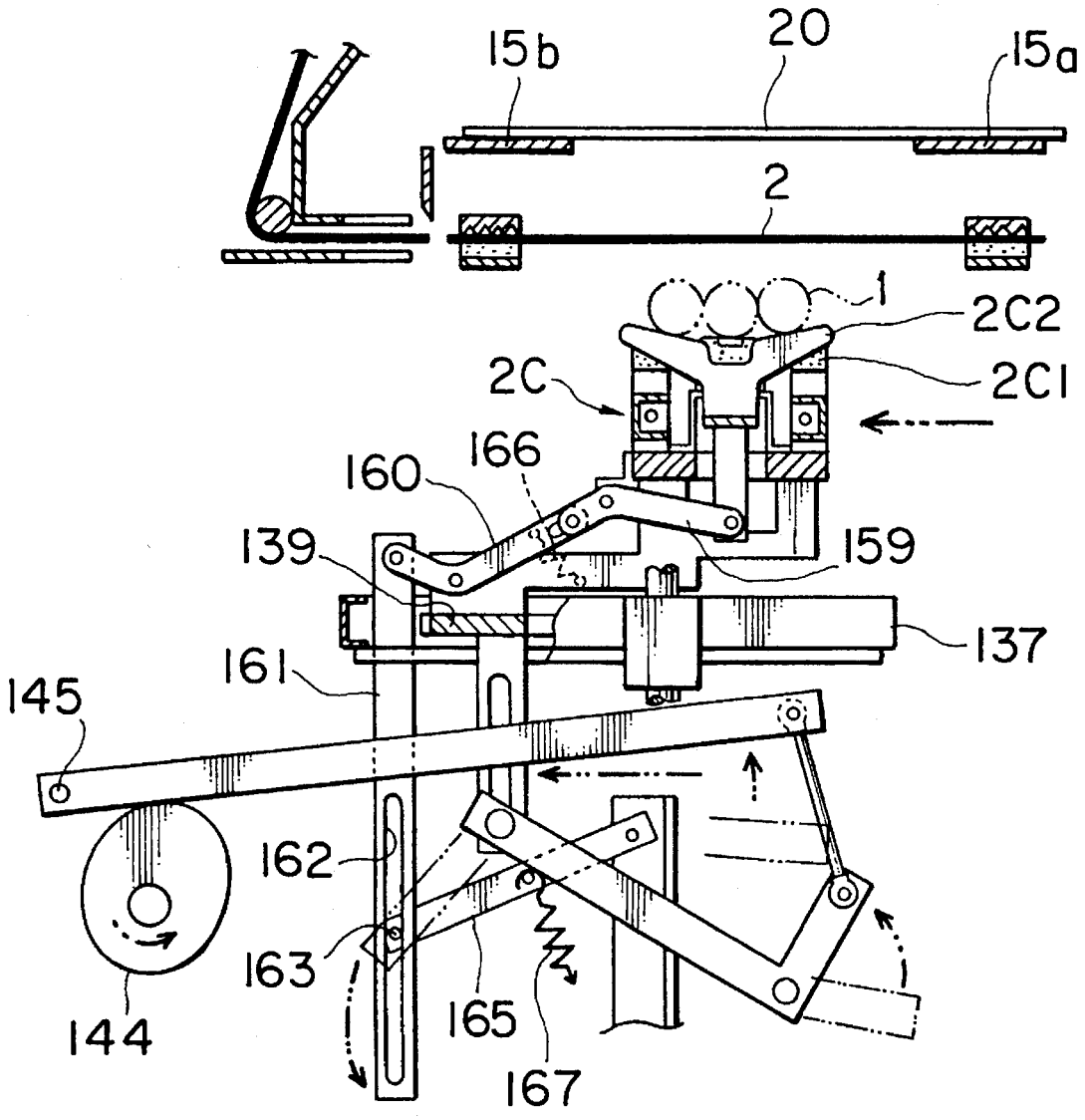
FIG. 32 is a schematic view showing the state where the carrying base is horizontally moved from the carrying-in section to the position under the packing section.
Figure 33:
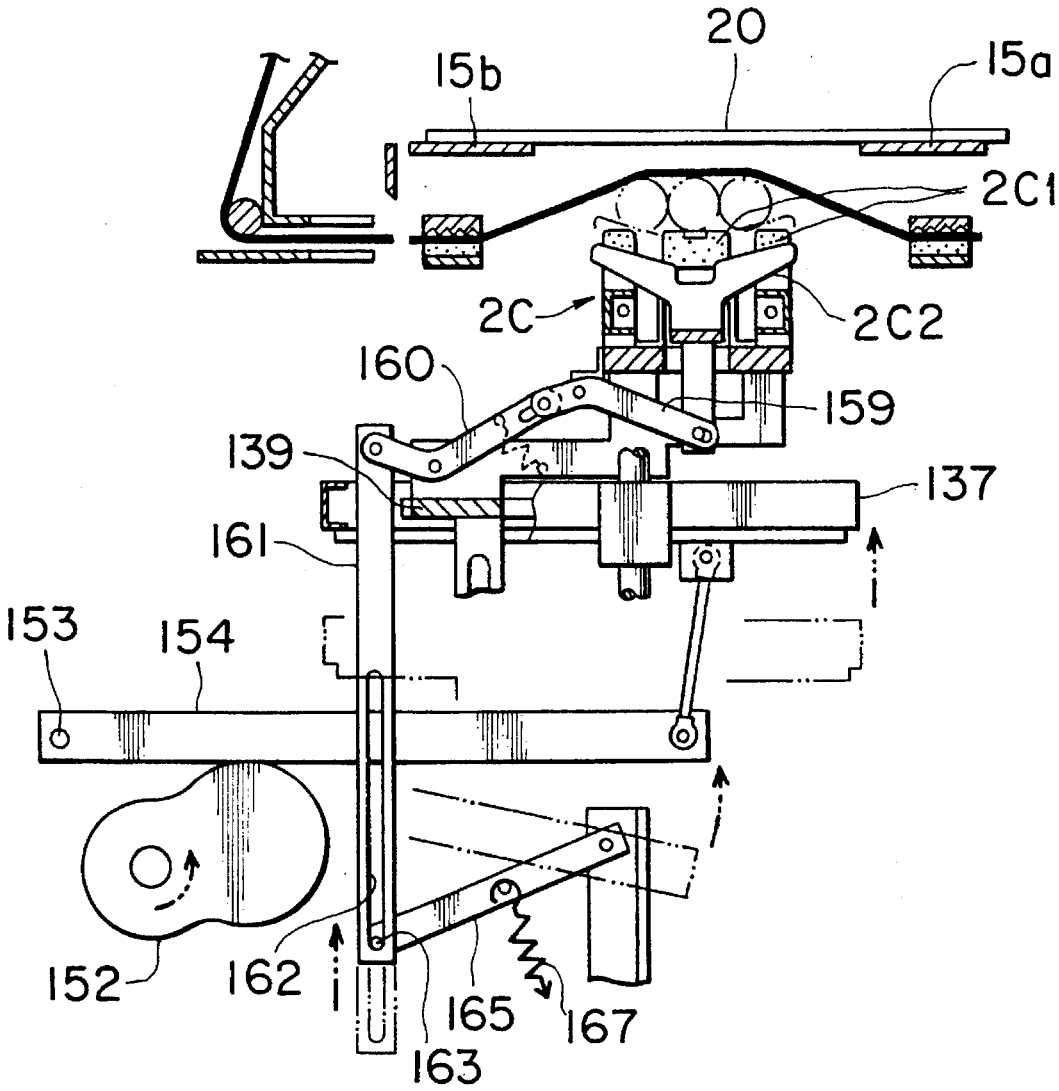
FIG. 33 is a schematic view showing the state where the carrying base is vertically ascended to-the film of the packing section and receives the article on first receiving portions in place of the second receiving portions.
Figure 34:
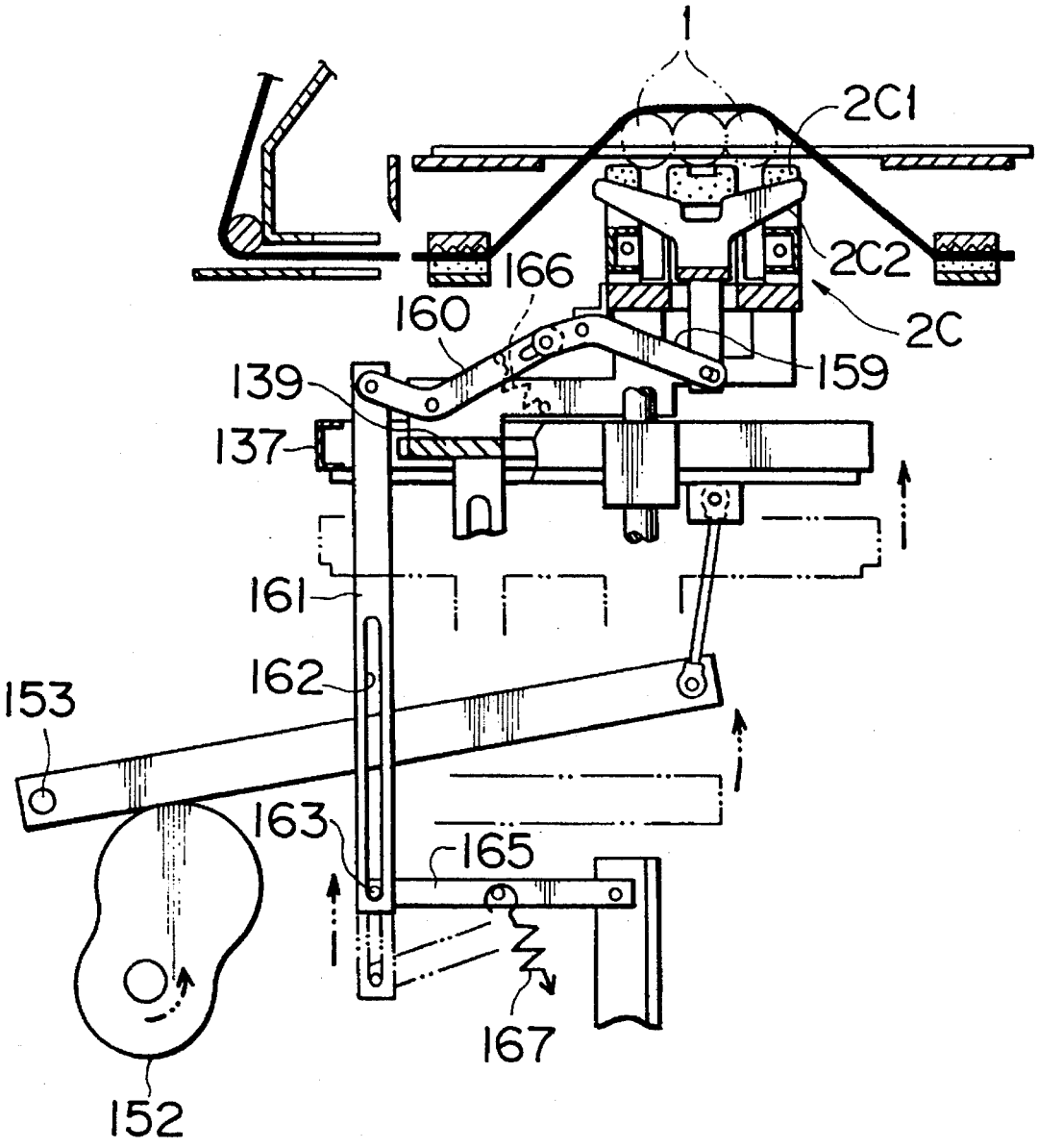
FIG. 34 is a schematic view showing the state where the carrying base perfectly pushes up the article ascended up to the upper limit position toward the film.
Figure 35:
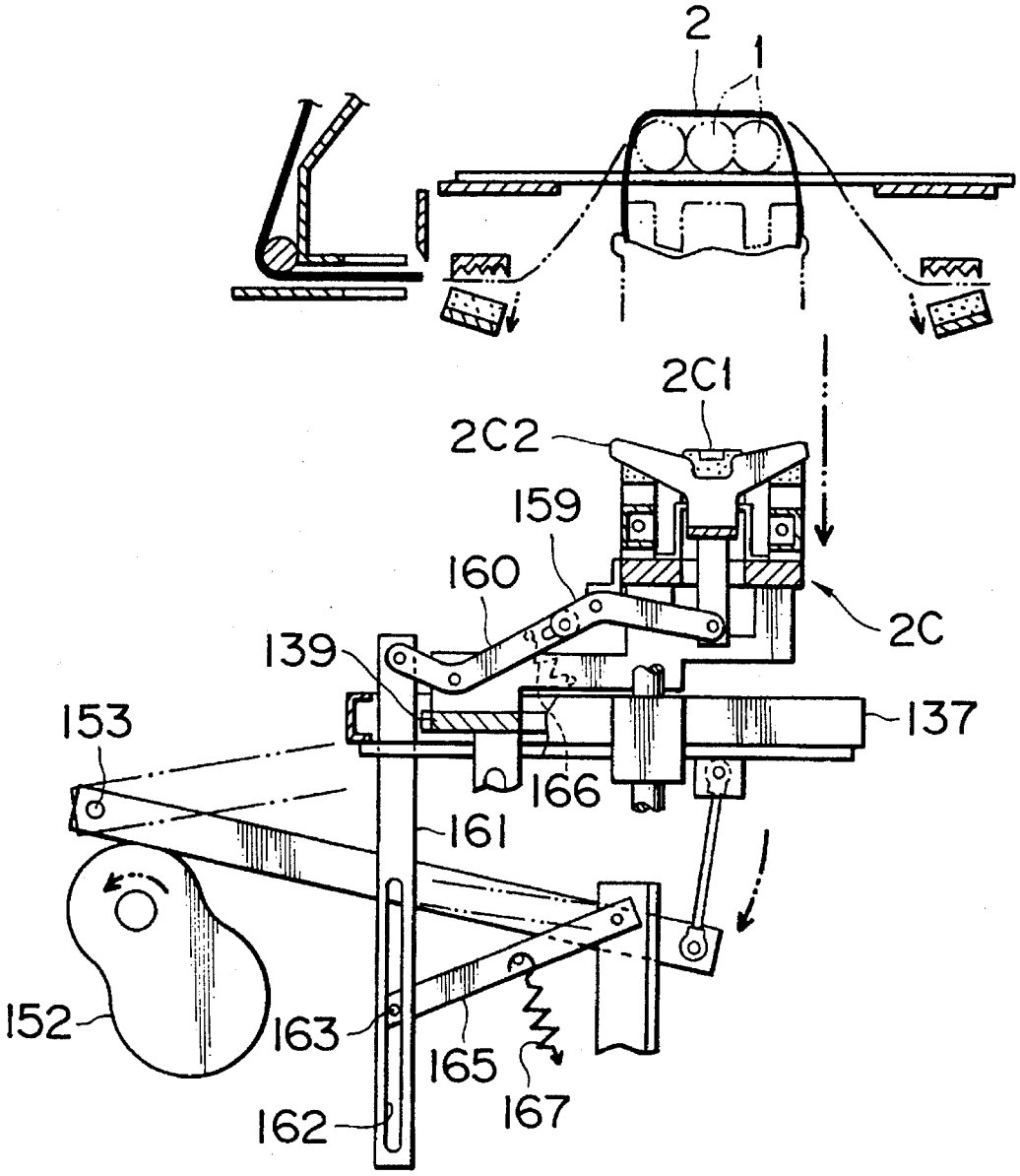
FIG. 35 is a schematic view showing the state where the carrying base is descended to the position under the packing section after completion of the pushing-up of the article to the film.

Namely, the carrying base 2C is ascended from the state in FIG. 27 to the state in FIG. 31 at the carrying-in section A; and ascended from the state in FIG. 32 to the state in FIG. 34 and descended from the state in FIG. 34 to the state in FIG. 35 at the packing section B.

In the figures, reference numeral 156 indicates a spring material stretched from the midway in the length direction of the rocking arm B154 to the machine casing 3. The spring material 156 hangs the rocking arm B154 for reducing the load of the main motor 142 when the carrying base 2C is ascended.

The elevating mechanism L holds the second receiving portions 2C2 in such a state that the second receiving portions 2C2 project higher than the upper surface of the placing surfaces 132 of the first receiving portions 2C1, so that the article 1 is supplied on the second receiving portions 2C2 when the article 1 is supplied from the carrying-in section A to the carrying base 2C and is carried to the position near the packing section B. Further, in order that the carrying base 2C on which the article 1 is placed is vertically ascended from the position under the packing section B to the film 2, and is supplied on the first receiving portions 2C1 in place of the second receiving portions 2C2 with the timing that the upper surface of the article is covered with the film 2, the elevating mechanism L is operated to vertically move the second receiving portions 2C2 such that the second receiving portions 2C2 are sunk lower than the upper surfaces of the placing portions 132 of the first receiving portions 2C1.

Figure 30:
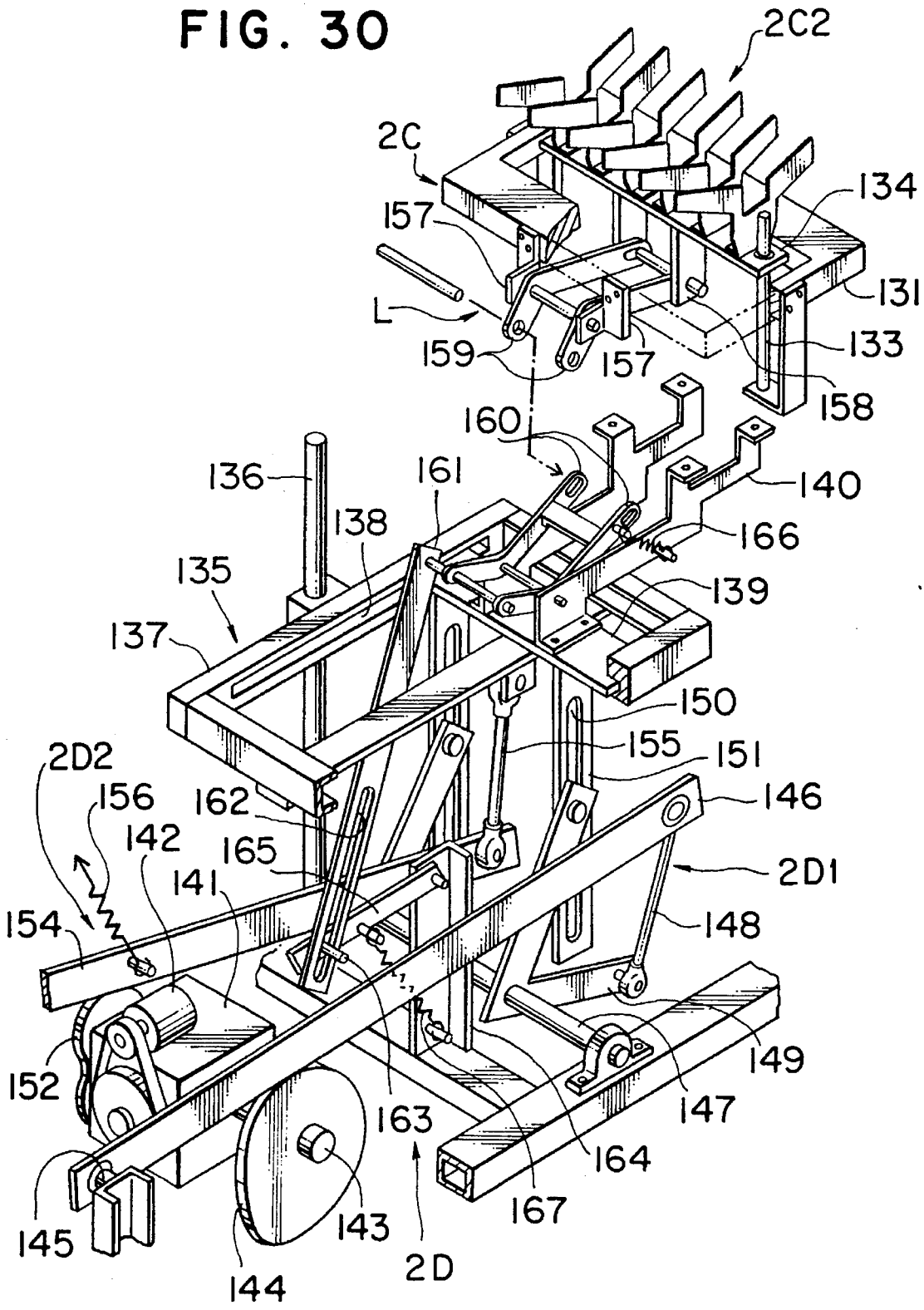
FIG. 30 is a perspective view of main parts showing a drive mechanism for moving the carrying base in the horizontal and vertical directions and an elevating mechanism for elevating and lowering second receiving portions of the carrying base.

The elevating mechanism L includes first links of an approximately dogleg shape which are rotatably supported by brackets 157 mounted on one long side of the head base 131 with one end release ends rotatably connected to connecting plates 158 hung from the lower surface of the head base 131; second links 160 of an approximately dogleg shape which are rotatably supported by the supporting legs 140 for supporting the head base 131 with one end release ends rotatably supported by the other end release ends of the first links 159; a hanging plate 161 hung such that the upper end is rotatably supported by the other end release end of the second link 160; and a supporting lever 165 is formed such that one end release end is slidably connected along a slot 162 formed on the lower end side of the hanging plate 162 through a connecting pin 163, the other end release end is fixed on the bottom portion of the machine casing 3 and is rotatably supported on the upper end of a column frame 164 erected with a suitable height (see FIG. 30).

In the figure, reference numeral 166 indicates a spring material stretched extending from the connecting end of the second link 160 to the supporting legs 140 for supporting the head base 131 for energizing the connecting end side between the second link 160 and the first link 159 clockwise and for holding the ascending and projecting state of the second receiving portions 2C2 from the placing portions 132 of the first receiving portions SC1. Reference numeral 167 indicates a spring material having a spring force larger than that of the spring material 166, which is stretched between the supporting lever 165 and the column frame 164 set to generate the spring force for energizing the supporting lever 165 to prevent the movement of the hanging plate 161 accompanied by the ascending movement of the carrying base 2C2 when the upper surface of the article 1 is covered with film 1.

Namely, in the carrying base 2C of this embodiment, the second receiving portions 2C2 are supported by the spring force of the spring material 166 in such a state that the second receiving portions 2C2 are ascended and projected higher than the placing portions 132 of the first receiving portions 2C1; the carrying base 2C moved to the position under the packing section B is started to be ascended and the connecting pin 163 of the supporting lever 165 collided and are engaged with the lower end of the slot 162 of the hanging plate 161 ascended together with the ascending movement of the carrying base 2C when the upper surface of the article 1 is covered with the film 2, so that the movement of the hanging plate 161 is stopped by the spring force of the spring material 167. Thus, the second receiving portions 2C2 are descended lower than the placing portions 132 of the first receiving portions 2C1 and sunk between the first receiving portions 2C1, so that a plurality of the articles 1 received not to be disturbed in the alignment and not to be rolled are supplied on the first receiving portions 2C1 with the approximately flat upper surfaces (from the state in FIG. 32 to the state in FIG.33).

The packing operation using the above carrying base 2C will be described with reference to FIGS. 31 to 36. First, the article 1 is placed on the carrying-in section A and an operational switch of the packing apparatus is turned on. After completion of the weighing by the weighting meter 5, the operation is started, and the carrying base 2C which stands-by under the carrying-in section A in such a state that the second receiving portions 2C2 project higher than the first receiving portions 2C1 by the spring material 166 is ascended by the vertically operating section 2D2, to thus receive the article 1 on the second receiving portions 2C2 from the carrying-in section A (the state in FIG. 31). At the same time, the carrying base 2C is moved to the position under the packing section B by the horizontally operating section 2D1 in such a state as to be kept in its height, to carry the article 1 to the same position (the state in FIG. 32). At this time, the hanging plate 161 hung such that the upper end is rotatably supported by the second link 160 constituting the elevating mechanism L is free with respect to the supporting lever 165. Thus, the hanging plate 161 is ascended along with the ascending of the carrying base 2C.

After that, the carrying base 2C moved to the position under the packing section B is started to be vertically ascended to the film 2 of the packing section B by the vertically operating section 2D2. Then, when the article 1 is vertically carried up to the ascending area where the upper surface of the article 1 received on the second receiving portions 2C2, the connecting pin 162 of the supporting lever 165 is locked with the lower end of the slot 162 of the hanging plate 161, so that the movement of the hanging plate 161 is stopped by the spring material 167. Thus, only the first receiving portions 2C1 of the carrying base 2C continuously ascended are further ascended and project higher than the second receiving portions 2C2, to receive the article 1 from the second receiving portions 2C2 (the state in FIG. 33). The carrying base 2C in which the article 1 is received on the first receiving portions 2C1 is vertically ascended up to the upper limit where the front and rear edges and the right and left edges of the film 2 are folded under the bottom side of the article 1 by the front and rear folding plates 15*a* and 15*b* and the right and left folding plates 20, thus completing the carrying of the article 1 to the packing section B by the carrying base 2C. At this time, the hanging plate 161 is ascended up to the upper limit together with the carrying base 2C against the spring material (the state in FIG. 34).

After that, the carrying base 2C is vertically descended by the vertically operating section 2D2, and the locking state of the locking pin 163 of the supporting lever 165 to the lower end of the slot 162 of the hanging plate 161 is released, so that the second receiving portions 2C2 are ascended by the spring material 166 and projects higher than the first receiving portions 2C1 again, thus returning the article 1 to the state to be removed from the carrying-in section A (see FIGS. 35 and 36). Thereafter, the above operations are repeated, to perform the packing for the articles 1.

Accordingly, in this embodiment, in carrying the article 1 from the carrying-in section A to the packing section B, a plurality of the articles 1 are supplied on the second receiving portions 2C2, so that the articles 1 are prevented from being disturbed in the alignment and from being rolled, and the carrying speed of the articles from the carrying-in section to the packing section is extremely increased, which improves the workability.

When the ascending and pushing-up action for covering the upper surface of the article 1 with the film 2 is completed, the article 1 is supplied from the second receiving portions 2C2 to the first receiving portions 2C1 with the flat upper surfaces, so that it is possible to certainly perform the beautiful packing for a plurality of the articles 1 in such a state as to be regularly aligned in a lateral row in folding the front and rear, and the right and left side edges of the film 2 under the bottom side of the article 1 by the front and rear folding plates 15*a* and 15*b* and the right and left folding plates 20.

Further, it is possible to prevent such a problem that if the receiving portion of the article 1 is sunk, the folding plates do not enter under the article 1 but are contacted therewith, thus causing the damage on the bottom portion of the article 1, and hence to prevent the lowering of the article's value even in the no-tray packing form.

Additionally, since the reaction between the ascending movement of the carrying base 2C in receiving the article 1 from the carrying-in section A and the weight of the article itself is damped by the spring material 166 for supporting the second receiving portions 2C2, it is possible to stably and smoothly receive the article from the carrying-in section A, and hence to prevent the disturbance in the posture of the article during carrying.

Figure 37:
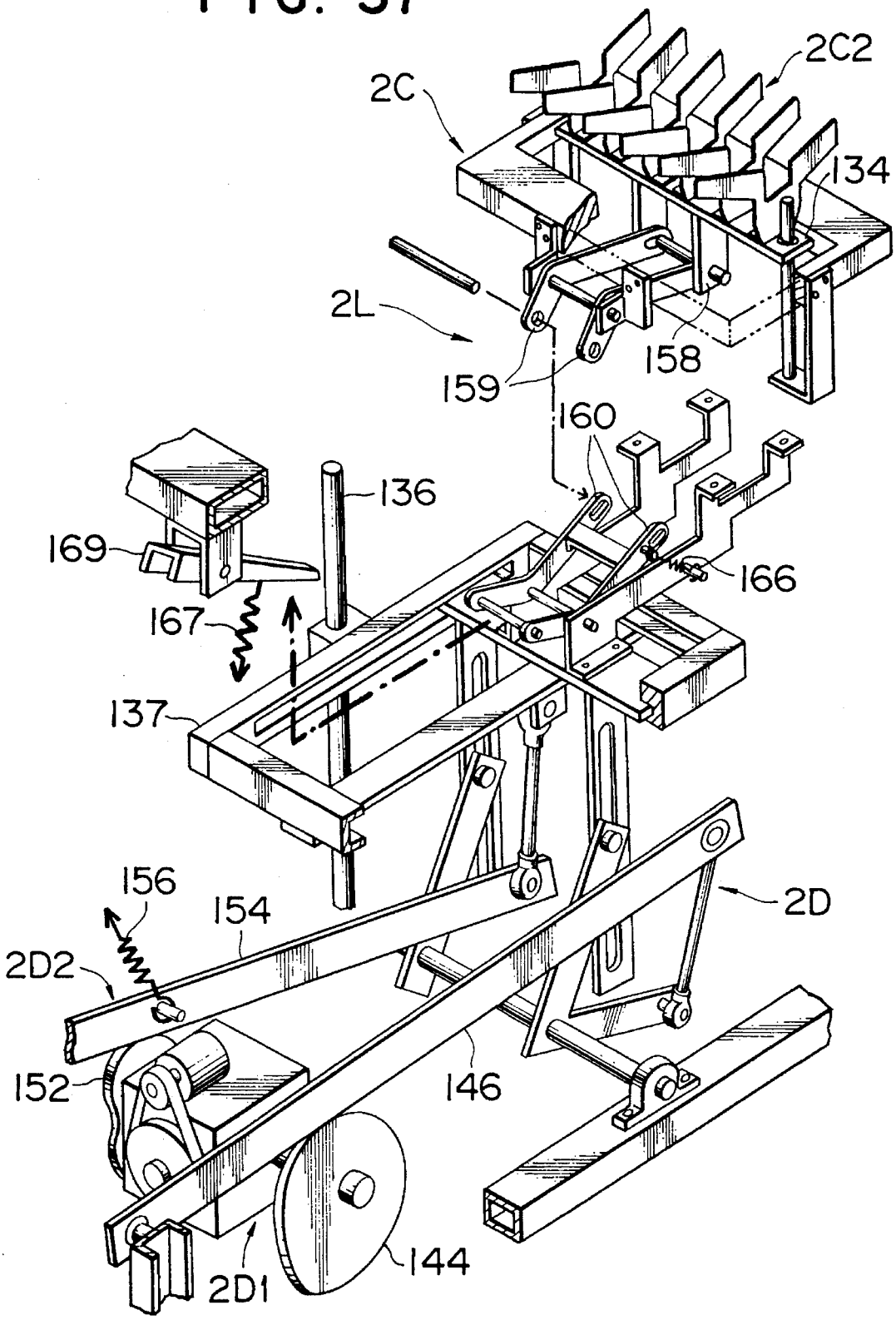
FIG. 37 is a perspective view of a main part showing another embodiment of an elevating mechanism for elevating and lowering the second receiving portions of the carrying base.
Figure 38:
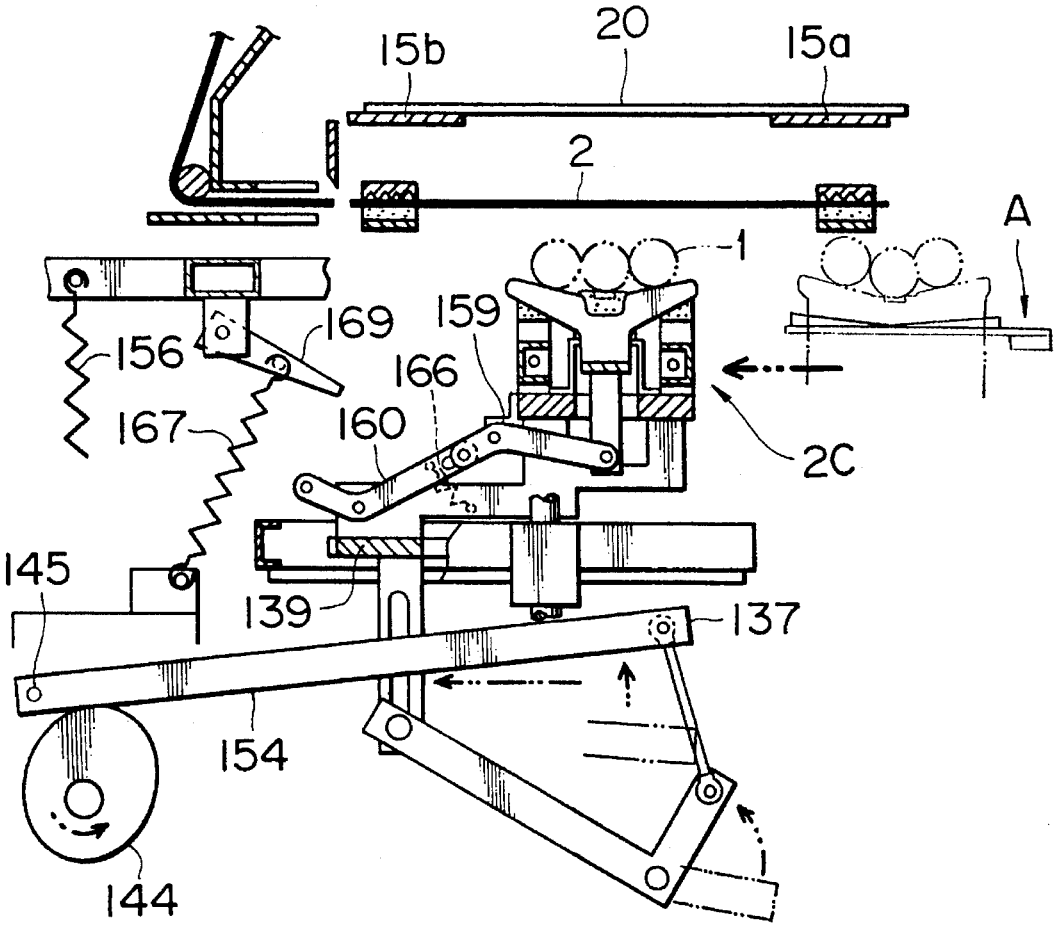
FIG. 38 is a schematic view showing the state where the carrying base is horizontally moved from the carrying-in section to the position under the packing section.
Figure 39:
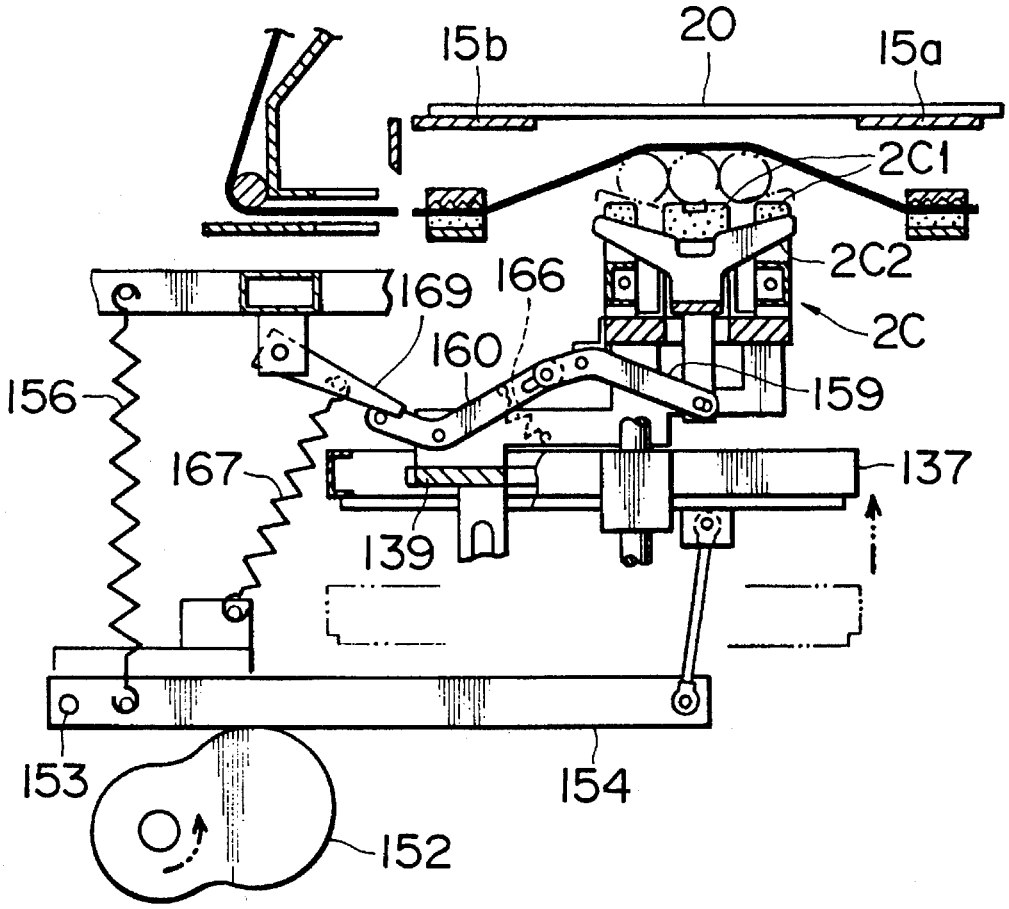
FIG. 39 is a schematic view showing the state where the carrying base is vertically ascended to-the film of the packing section and receives the article on the first receiving portions in place of the second receiving portions.

FIGS. 37 to 39 show a further embodiment of an elevating mechanism L for vertically moving the second receiving portions 2C2 supported in such a state so as to project upwardly by the spring material 166 in such a manner as to be sunk lower than the upper surface of the placing portions 132 of the first receiving portions 2C1.

This elevating mechanism 2L is so constructed as follows: Namely, in place of the hanging plate 161 hung such that the upper end thereof is rotatably supported on the other end release end of the second link 160, the hanging lever 169 for hanging the other end release end of the second link 160 is rotatably supported by the machine casing 3 as shown in the figure, and it is disposed so as to be inclined forwardly of the machine casing 3 by the spring material 167.

Namely, when the carrying base 2C, which receives the article 1 from the carrying-in section A and is horizontally moved to the position under the packing section B, is vertically ascended toward the film 2 of the packing section B by the vertically operating section 2D2 for vertically ascending the article 1 up to the ascending area where the upper surface of the article 1 is covered with the film 2, the other end release end of the second link 160 is hung by the inclined end portion of the hanging lever 169, so that the second receiving portions 2C2 are descended and sunk lower than the upper surfaces of the first receiving portions 2C1, and thereby the article 1 is supplied on the first receiving portions 2C1 (see FIG. 39).

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

We claim:

1. A packing method comprising the steps of carrying a substance to be packed from a carrying-in section of a packing apparatus to a position under a packing section, said carrying-in section being horizontally spaced from a position under said packing section and located at a peripheral portion of the packing apparatus; horizontally supplying and stretching a film at said packing section;

lifting a carrying base from a position under said carrying-in section in such a manner that an upper surface of said carrying base is positioned higher than an upper surface of said carrying-in section, and receiving said substance to be packed from said carrying-in section to the upper surface of said carrying base;

horizontally moving said carrying base on which said substance to be packed is placed to the position under said packing section for carrying said substance to be packed to said position under said packing section;

and vertically moving said carrying base to said packing section, and pushing-up said substance to be packed to said film at said packing section for covering an upper surface of said substance to be packed with said film; folding the end portions of said film under a bottom portion of said substance to be packed.

2. A packing method comprising the steps of carrying a substance to be packed from a carrying-in section of a packing apparatus to a position under a packing section, said carrying-in section being horizontally spaced from a position under said packing section and located at a peripheral portion of the packing apparatus; horizontally supplying and stretching a film at said packing section;

positioning a carrying base under said carrying-in section, and lowering said carrying-in section in such manner that an upper surface of said carrying-in section is positioned lower than an upper surface of said carrying base, and receiving said substance to be packed from said carrying-in section to the upper surface of said carrying base;

horizontally moving said carrying base on which said substance to be packed is placed to a position under said packing section for carrying said substance to be packed to said position under said packing section;

vertically moving said carrying base to said packing section, and pushing-up said substance to be packed to said film at said packing section for covering an upper surface of said substance to be packed with said film; and folding the end portions of said film under a bottom portion of said substance to be packed.

3. A packing apparatus for carrying a substance to be packed from a carrying-in section for said substance to be packed to a position under a packing section, means for horizontally supplying and stretching a film at said packing section; said substance to be packed being lifted to said film for covering an upper surface of said substance to be packed with said film; the end portions of said film being folded under a bottom portion of said substance; said packing apparatus comprising;

a carrying-in section on which said substance to be packed is placed, said carrying-in section being horizontally spaced from a position under said packing section and located at a peripheral portion of the packing apparatus;

a carrying base being movable in horizontal and vertical directions;

means for vertically lifting said carrying base from a position under said carrying-in section in such a manner that an upper surface of said carrying base is positioned higher than an upper surface of said carrying-in section, said substance being supplied from said carrying-in section to said carrying base;

means for horizontally moving said carrying base on which said substance is placed to a position under said packing section for carrying said substance to be packed to said position under said packing section; and means for vertically moving said carrying base to said packing section, and pushing-up said substance to be packed to said film at said packing section.

4. A packing apparatus for carrying a substance to be packed from a carrying-in section to a packing section, said substance being packed with a stretched film at said packing section; said packing apparatus comprising:

a packing section having folding means;

a roll having a wound stretched film;

film drawing means for holding the leading edge of said film and drawing said film from said roll to said packing section by a specified length;

right and left clamping means for holding said drawn film in a stretched state at said packing section;

a carrying-in section on which said substance to be packed is placed said carrying-in section being horizontally spaced from a position under said packing section and located at a peripheral portion of the packing apparatus;

a carrying base being movable in horizontal and vertical directions;

means for vertically lifting said carrying base from a position under said carrying-in section in such a manner that an upper surface of said carrying base is positioned higher than an upper surface of said carrying-in section, said substance being supplied from said carrying-in section to said carrying base;

means for horizontally moving said carrying base on which said substance to be packed is placed to a position under said packing section for carrying said substance to be packed to said position under said packing section;

means for vertically moving said carrying base from said packing section, and pushing-up said substance to be packed to said film at said packing section; and said folding means folding the end portions of said film under a bottom portion of said article.

5. A packing method according to claim 1, further comprising connecting a weighing meter to said carrying-in section for weighing said substance to be packed on said carrying-in section.

6. A packing apparatus according to claim 3, wherein a weighing meter is connected to said carrying-in section for weighing said substance to be packed on said carrying-in section.

7. A packing apparatus according to claim 4, wherein right and left folding plates of said folding means are so constructed as to be movable in a direction to be separated from or close to each other; right and left movable clamping plates being movable to be separated from or close to lower surfaces of said right and left folding plates, and means for synchronizing movement of the right and left clamping plates with the movements of said folding plates in the direction of being separated from or close to each other, said right and left clamping plates being disposed under said right and left folding plates.

8. A packing apparatus according to claim 7, wherein said right and left movable clamping plates hold the right and left side edges of said film by being press-contacted with the lower surfaces of said right and left folding plates.

9. A packing apparatus according to claim 7, wherein said right and left movable clamping plates are synchronized with the movements of said right and left folding plates in the direction of being separated from or being close to each other to be press-contacted with lower surfaces of said right and left folding plates; and said right and left movable clamping plates being separated from said right and left folding plates when said right and left folding plates are being moved in the direction of being close to each other, to be returned to standing-by positions.

10. A packing apparatus according to claim 4, said film drawing means comprising:

a front gripper for holding a leading edge portion of the film extending from said roll of film, and drawing said film by a specified length;

a rear gripper for holding a rear end portion of said film drawn by said front gripper;

a cutter for cutting said film held by said rear gripper at a position behind the holding portion;

film folding plates for holding the leading edge of said cut film;

transfer mechanisms for moving said front gripper and rear gripper in a film drawing direction, said front and rear grippers being movable to position said film held by said grippers in such a manner that the center of said film corresponds to the center of said packing section in which said substance to be packed is carried; and means for locating said rear gripper at a position so as not to obstruct the movement of said front gripper when the leading edge of said film held by said film holding plates is clamped by said front gripper.

11. A packing apparatus according to claim 10, wherein front and rear folding plates of said folding means are respectively disposed on said packing section at front and rear portions in the film carrying direction; and said front and rear folding plates are respectively moved toward the center of said packing section on which said substance is placed, thereby bringing said portions of said film into press-contact at the center of the bottom portion of said substance to be packed.

12. A packing apparatus according to claim 4, said film drawing means comprising:

a front gripper for holding a leading edge portion of the film extended from said roll of film, and drawing said film by a specified length;

a rear gripper for holding a rear end portion of said film drawn by said front gripper;

a cutter for cutting said film held by said rear gripper at a position behind the holding portion;

film holding plates for holding the leading edge of said cut film;

transfer mechanisms for moving said front gripper and said rear gripper for holding the front and rear ends of said film in the film drawing direction, and positioning said film held by said grippers in such a manner that a center of said film corresponds to a center of said packing section, and enlarging the distance of movement of said front gripper at that time as compared with the distance of movement of said rear gripper, thereby pre-stretching said film in the longitudinal direction.

13. A packing apparatus according to claim 12, wherein front and rear folding plates of said folding means are respectively disposed at said packing section on front and rear portions in the film drawing direction; and said front and rear grippers for holding the front and rear ends of said film are respectively moved toward the center of said packing section by said transfer mechanisms, and are accompanied by folding operations of the front and rear portions of said film by respectively moving the front and rear folding plates toward the center of said packing section.

14. A packing apparatus according to claim 12, further comprising right and left clamping means for pre-stretching said film in a width direction by being moved outwardly from said film while holding both said portions of said film.

15. A packing apparatus according to claim 4, wherein said folding means comprises front and rear, and right and left folding plates; a heater being provided in a folding edge of said folding plate in which the folding operation is finally completed; and butted portions of said film being subjected to heat sealing by said heater when film is folded under a bottom portion of said substance to be packed.

16. A packing apparatus according to claim 15, wherein said heater is formed in a corrugated shape, and is provided along the folding edge.

17. A packing apparatus according to claim 4, further comprising detecting means for detecting whether or not said substance already packed is removed from said packing section, and on the basis of the detected result, allowing the next packing operation to be started.

18. A packing apparatus including a carrying base for receiving a substance to be packed from a carrying-in section by lifting movement from a lower side of said carrying-in section; means for horizontally carrying said substance to be packed from the carrying in section to a position under a packing section in which a film is drawn, said carrying-in section being horizontally spaced from a position under said packing section and located at a peripheral portion of said packing apparatus; and means for lifting and pushing-up said substance to be packed toward said film up to an area where an upper surface of said substance to be packed is covered with said film, said carrying base comprising:

first receiving portions, each having an approximately flat upper surface, juxtaposed in one direction at specified intervals for receiving said substance to be packed;

second receiving portions, each having an upper surface with a recessed shape being gradually inclined toward a central portion, said second receiving portions being vertically movable between said first receiving portions for receiving said substance to be packed;

wherein the upper surfaces of said second receiving portions project higher than the upper surfaces of said first receiving portions when receiving said substance to be packed or in horizontally moving said substance to be packed; and the upper surfaces of said second receiving portions project lower than the upper surfaces of said first receiving portions at least when the lifting and pushing-up operation of said substance to be packed toward said film is completed.

19. A packing apparatus according to claim 18, wherein said second receiving portions are supported by a spring material to be biased toward projecting higher than the upper surface of said first receiving portions.

20. A packing apparatus according to claim 3, wherein said carrying-in section comprises a plurality of placing members formed in an approximately comb-like shape, and said carrying base comprises a plurality of raised members to be lifted while passing through gaps between said placing members of said carrying-in section.

21. A packaging method according to claim 2, further comprising connecting a weighing meter to said carrying-in section for weighing said substance to be packed on said carrying-in section.

22. A packing apparatus according to claim 4, wherein a weighing meter is connected to said carrying-in section for weighing said substance to be packed on said carrying-in section.

23. A packing apparatus according to claim 8, wherein said right and left movable clamping plates are synchronized with the movements of said right and left folding plates in the direction of being separated from or being close to each other to be press-contacted with lower surfaces of said right and left folding plates; and said right and left movable clamping plates being separated from said right and left folding plates when said right and left folding plates are being moved in the direction of being close to each other, to be returned to standing-by positions.

24. A packing apparatus according to claim 4, wherein said carrying-in section comprises a plurality of placing members formed in an approximately comb-like shape, and said carrying base comprises a plurality of raised members to be lifted while passing through gaps between said placing members of said carrying-in section.

25. A packing apparatus according to claim 18, wherein said carrying-in section comprises a plurality of placing members formed in an approximately comb-like shape, and said carrying base comprises a plurality of raised members to be lifted while passing through gaps between said placing members of said carrying-in section.

* * * * *